US006965297B1

(12) United States Patent
Sandahl

(10) Patent No.: US 6,965,297 B1
(45) Date of Patent: Nov. 15, 2005

(54) WIDE AREA RADIO PAGING SYSTEM

(75) Inventor: Joel Ernest Sandahl, Southlake, TX (US)

(73) Assignee: Enhanced Messaging Systems, Inc., Southlake, TX (US)

( * ) Notice: Subject to any disclaimer, the term of this patent is extended or adjusted under 35 U.S.C. 154(b) by 0 days.

(21) Appl. No.: 09/387,804

(22) Filed: Sep. 1, 1999

Related U.S. Application Data

(60) Provisional application No. 60/098,871, filed on Sep. 2, 1998.

(51) Int. Cl.[7] ..... G08B 5/22
(52) U.S. Cl. ..... 340/7.25; 340/7.2
(58) Field of Search ..... 340/7.24, 7.25, 340/7.27, 7.28, 7.29, 7.2

(56) References Cited

U.S. PATENT DOCUMENTS

| | | | | |
|---|---|---|---|---|
| 4,178,476 A | | 12/1979 | Frost | |
| 4,891,638 A | | 1/1990 | Davis | |
| 5,196,842 A | | 3/1993 | Gomez et al. | |
| 5,254,986 A | * | 10/1993 | DeLuca | 340/825.44 |
| 5,396,230 A | | 3/1995 | Motegi | |
| 5,491,469 A | * | 2/1996 | Schwendeman | 340/7.1 |
| 5,506,886 A | | 4/1996 | Maine et al. | |
| 5,684,859 A | | 11/1997 | Chanroo et al. | |
| 5,752,163 A | * | 5/1998 | Robinson | 455/31.3 |
| 5,802,470 A | * | 9/1998 | Gaulke et al. | 455/426.1 |
| 5,862,484 A | | 1/1999 | Lee | |
| 5,917,424 A | * | 6/1999 | Goldman et al. | 340/825.44 |
| 5,918,158 A | | 6/1999 | LaPorta et al. | |
| 5,918,179 A | | 6/1999 | Foladare et al. | |

* cited by examiner

*Primary Examiner*—Michael Horabik
*Assistant Examiner*—Matsuichiro Shimizu
(74) *Attorney, Agent, or Firm*—Kenneth J. Lukacher

(57) ABSTRACT

A system for delivering page messages to paging units over a wide area is provided through multiple transmission systems. The system has a controller for routing page messages to each paging unit through the transmission system to which the paging unit is registered. Each transmission system periodically sends a system message having at least a unique identifier for the transmission system. Each paging unit receives system messages of at least one of the transmission systems when located in the transmission system's coverage area, and receives page messages from the transmission system registered to the paging unit when located in that transmission system's coverage area. Paging units update their registration with the controller in accordance with the identifier of received system messages different from their current registered identifier via user enabled or automatic means. The controller may resend messages to paging units which were sent during periods of unlikely reception.

71 Claims, 23 Drawing Sheets

= COVERAGE FROM REGIONAL TRANSMISSION SYSTEM(S)

REGIONAL SYSTEM (RegID)

| REGIONAL SYSTEM ID (RegID)<br>RegID = SID + RID + FID | SYSTEM ID (SID) + REGIONAL ID (RID) + FREQUENCY (FID) | | |
|---|---|---|---|
| | SID | RID | FID |

| BIT POSITIONS | 19 | | | 16 | 15 | | | 12 | 11 | | | 8 | 7 | | | 4 | 3 | | | 0 |
|---|---|---|---|---|---|---|---|---|---|---|---|---|---|---|---|---|---|---|---|---|
| SIDMASK = 1040384 52 | 1 | 1 | 1 | 1 | 1 | 1 | 1 | 0 | 0 | 0 | 0 | 0 | 0 | 0 | 0 | 0 | 0 | 0 | 0 | 0 |
| RIDMASK = 8176 54 | 0 | 0 | 0 | 0 | 0 | 0 | 0 | 1 | 1 | 1 | 1 | 1 | 1 | 1 | 1 | 1 | 0 | 0 | 0 | 0 |
| FIDMASK = 15 56 | 0 | 0 | 0 | 0 | 0 | 0 | 0 | 0 | 0 | 0 | 0 | 0 | 0 | 0 | 0 | 0 | 1 | 1 | 1 | 1 |
| SUM OF MASKS = ALL ONES | 1 | 1 | 1 | 1 | 1 | 1 | 1 | 1 | 1 | 1 | 1 | 1 | 1 | 1 | 1 | 1 | 1 | 1 | 1 | 1 |
| RegID = 8289 | 0 | 0 | 0 | 0 | 0 | 0 | 1 | 0 | 0 | 0 | 0 | 0 | 0 | 1 | 1 | 0 | 0 | 0 | 0 | 1 |
| SID = 8192 | 0 | 0 | 0 | 0 | 0 | 0 | 1 | 0 | 0 | 0 | 0 | 0 | 0 | 0 | 0 | 0 | 0 | 0 | 0 | 0 |
| RID = 96 | 0 | 0 | 0 | 0 | 0 | 0 | 0 | 0 | 0 | 0 | 0 | 0 | 0 | 1 | 1 | 0 | 0 | 0 | 0 | 0 |
| FID = 1 | 0 | 0 | 0 | 0 | 0 | 0 | 0 | 0 | 0 | 0 | 0 | 0 | 0 | 0 | 0 | 0 | 0 | 0 | 0 | 1 |

FIG. 6

CONFIRMATION MESSAGE (MESSAGE ADDRESSED TO UnitID)

| REGIONAL SYSTEM ID (RegID) |
|---|

CONTROL INPUT INFORMATION
(AUTOMATIC OR SEMI-AUTOMATIC)

NoSrvc MEMORY ARRAY

| | NO SERVICE MEMORY ARRAY INDEX (NoSrvcIndex) | |
|---|---|---|
| ELEMENT #0 | BEGINNING TIME (BEGIN) | ENDING TIME (END) |
| ELEMENT #1 | BEGINNING TIME (BEGIN) | ENDING TIME (END) |
| ELEMENT #2 | BEGINNING TIME (BEGIN) | ENDING TIME (END) |

FIG. 14

CONTROL INPUT INFORMATION (MANUAL)

| |
|---|
| UNIT IDENTIFICATION (UnitID) |
| REGIONAL SYSTEM ID (RegID) |
| NumberOfHoursToRetransmit |

NumberOfHoursToRetransmit =NoSrvc #
NoSrvcIndex END - NoSrvc #0 BEGIN

FIG. 16

ROUTING DATABASE

| | MsgInID | GroupFlg | GroupID/UnitID | RegID |
|---|---|---|---|---|
| UNIT # 1 | MsgInID #1 | GroupFlg | GroupID/UnitID FOR MsgInID #1 | CURRENT RegID FOR MsgInID #1 |
| UNIT # 2 | MsgInID #2 | GroupFlg | GroupID/UnitID FOR MsgInID #1 | CURRENT RegID FOR MsgInID #2 |
| UNIT # 3 | MsgInID #3 | GroupFlg | GroupID/UnitID FOR MsgInID #1 | CURRENT RegID FOR MsgInID #3 |

FIG. 17

MESSAGE DATABASE

| | UnitID | Msg | TIME |
|---|---|---|---|
| MESSAGE #1 | UnitID | THIS MESSAGE | TIME MESSAGE SENT |
| MESSAGE #2 | UnitID | THIS MESSAGE | TIME MESSAGE SENT |
| MESSAGE #3 | UnitID | THIS MESSAGE | TIME MESSAGE SENT |

FIG. 18

| GroupID | GROUP LIST |
|---|---|
| GroupID #1 | VARIABLE LENGTH LIST OF UnitIDs IN THIS GROUP |
| GroupID #2 | VARIABLE LENGTH LIST OF UnitIDs IN THIS GROUP |
| GroupID #3 | VARIABLE LENGTH LIST OF UnitIDs IN THIS GROUP |

WIDE AREA RADIO PAGING SYSTEM

DESCRIPTION

This application claims the benefit of priority to U.S. Provisional Application No. 60/098,871, filed Sep. 2, 1998.

FIELD OF THE INVENTION

The present invention relates to a radio paging system (and method) having radio paging units which move within a wide area including multiple geographic coverage areas, and in particular to a wide area radio paging system which enables registration of radio paging units with regional transmission systems associated with such geographic coverage areas. This invention is especially suitable for routing page messages to each of multiple radio paging units through the regional transmission system covering the geographic area in which each radio paging unit is located, and for reliably delivering page messages when each radio paging unit is not likely receiving message pages from the regional transmission system to which the paging unit is registered. The system also includes a method of handling page messages and routing them to paging units through regional transmission systems.

BACKGROUND OF THE INVENTION

Radio paging systems have been in use for many decades for sending page messages to radio paging units, such as pagers. Historically, radio paging systems have been one-way communication systems which broadcast radio paging messages to radio paging units, often worn personally by their users. Each message so broadcast includes certain coded information which enables a select radio paging unit (or a select group of radio paging units) to receive the message. In response to a received message, the radio paging unit usually alerts the user (audibly, visually or tactilely) so that the received message (numeric, alphanumeric or audio) might be retrieved by the user.

In the earliest radio paging systems, radio paging messages were broadcast from a single transmitter site. A site has an encoder for encoding page message, and a controller which sends such encoded messages via a transmitter and antenna. Due to the finite geographic coverage that can be realized between a transmitter and a receiver, radio paging systems now include the broadcasting of radio paging messages from one or more geographically dispersed transmitter sites, which may be grouped into transmission systems. Increasing the number of geographically dispersed transmitter sites broadens the geographic coverage of radio paging message delivery, thus increasing the user's freedom of mobility, and the convenience value of the paging service to the user. Increasing the number of transmitter sites, however, increases the cost of service, thus decreasing the attractiveness of the service to the user. The cost of service may be defined as a function of the number of transmitter sites used in the system divided by the radio paging message capacity that can be carried by the system. As each transmitter site has finite information carrying capacity, limiting the cost of service lies in limiting the number of transmitters used to deliver each radio paging message. Limiting the number of transmitter sites used to deliver a message without restricting the user's mobility requires that the system be able to broadcast messages only from the transmission site(s) actually required to deliver a message to a given radio paging unit or group of radio paging units, wherever the radio paging unit of the group might be at that moment in time. However, this requires the system to have knowledge regarding the location of the radio paging unit when messages are to be delivered.

Generally, there are three types of radio paging systems which propose solutions to the problem of determining the location of a radio paging unit. One type of radio paging system provides for the user to place a local telephone call to a local paging destination controller whenever the user arrives in a new area. The user identifies himself or herself and identifies his or her current area as that of the destination controller to which the phone call is made. This destination controller then contacts another controller which is associated with the origination of radio paging messages for the user and informs this controller that it is now the destination controller to be used for broadcasting radio paging messages to that user. Thereafter, until new information is input into a destination controller, radio paging messages are routed from the origination controller through land lines to the destination controller where the user's radio paging messages are broadcast from an associated transmitter.

There are a number of drawbacks associated with this type of system. The telephone number for the destination controller that the user must call is not usually a number that the user would readily know. Further, users traveling nationwide would be required to know thousands of telephone numbers for thousands of destination controllers, since each destination controller controls one transmitter site. The limited area of coverage from one transmitter site may require the user to make frequent telephone calls to different destination controllers. In addition to accessing the destination controllers, the users have no knowledge of when they are leaving an area covered by one destination controller (a transmitter site) and entering an area covered by another destination controller (another transmitter site), hence the user is unaware of when he or she needs to contact a new destination controller.

A second type of radio paging system also provides for the user to place a telephone call, but only to one known destination controller whenever the user arrives in a new area. In this type of system, the radio paging unit has means for determining its geographic position, such as via a Global Positioning System (GPS). When the user calls the destination controller, the user's identification information and geographic position information are communicated to the destination controller which, in turn, forwards the information to an origination controller associated with the user. When messages are received at the origination controller for delivery to the subject radio paging unit, the origination controller uses the geographic position information it has received to determine the appropriate delivery controller to route the message to so that the message can be broadcast from the transmitter site(s) serving the location defined by that geographic position information.

As with the first type system, there are several drawbacks associated with this second type system. This system requires the user to place long distance telephone calls back to the one destination controller assigned for use by this user in order to update his or her current geographic location information. The burden still rests with the user to determine when his or her geographic location has changed significantly enough to require a long distance telephone call to update geographic location information. This may be difficult since the user generally is unaware when he or she is leaving an area covered by one transmitter site and entering an area covered by another transmitter site. Further, the paging unit would be expensive since it may require additional circuitry for providing the geographic location information.

Both of the first and second types of systems provide for locating and controlling page message transmissions at a transmitter site level. This will often require frequent location updates to the system due to the limited coverage of a transmitter site as radio paging units move in large metropolitan areas, or when radio paging units are worn on users traveling through many geographic regions in a short period of time, such as on interstate highways. For example, if the coverage area of a transmission site is a 10-mile radius, a user traveling in a car at 60 miles per hour could require location updates every 20 minutes.

A third type of radio paging system provides for a radio paging unit with an acknowledgment transmitter to send a signal back to the home paging terminal when the radio paging unit arrives in a new location. The radio paging system transmits location identifiers, which, for example, may represent, the city, a service area, or geographic region. The radio paging unit determines that it has arrived in a new location when it receives a location identifier different from its home identifier. When the home paging terminal is notified of the radio paging unit's new location, the system forwards messages to the new location.

There are several drawbacks with this third type of radio paging system. The system requires the radio paging system to provide two-way radio paging, in which a companion frequency is provided for the transmission and reception of acknowledgment transmissions by the radio paging unit via the unit's acknowledgment transmitter. This requires a comprehensive network of receivers to receive the low power transmissions from the radio paging units in all locations where message delivery is required. Such receiver networks are costly to construct and maintain, resulting in higher paging service costs. Further, the system can operate only over limited geographic service where receiver networks are provided, and the incorporation of a radio transmitter in the radio paging unit to provide two-way radio paging increases considerably the cost of the radio paging unit.

The third type of radio paging system may use a cordless telephone, rather than an acknowledgment transmitter, to call the home paging terminal when arriving in a new location. This however requires the availability of cordless telephone service in all locations where message delivery is required. A situation not usually controlled by a radio paging service provider. Thus, universal service, geographically, cannot be assured. While potentially more convenient to users than the previous two types of radio paging systems, this system depends on an expensive receiver network or, in the alternative, the placement of long distance telephone calls to communicate with the home paging terminal in order to reroute message delivery to the current location. An example of the third type of radio paging system is described in U.S. Pat. No. 5,684,859.

Another aspect of radio paging is assuring message delivery when messages are routed to particular transmitter sites. As a practical matter, when users move about in wide area radio paging systems, there will be periods of time when messages are undeliverable due to limitations in radio coverage of the transmission site through which page messages are being sent. For example, when a user moves from one location in the system to another, there may be periods of time when the user's current location is not covered by any transmitter site. Further, there will always be delays between the user's actual movement to a new location and the updating of such location change information to the system. It is unlikely that messages arriving during these transitional periods will be delivered to the users. Without assuring page message delivery, messages may be lost if the user fails to update his or her location to the paging system as described in the above types of radio paging systems.

To assure message delivery in the first type of radio paging system discussed above, the user is required to place a local telephone call to the current destination controller before leaving the area to cause the system to hold his or her messages until he or she arrives at the new area, and then a second local telephone call to the associated destination controller to cause stored and future messages to be delivered to the new destination controller. This is inconvenient to users, especially when they may be unaware when they have left or entered a new area. The second and third types of radio paging systems described above lack a mechanism for assuring message delivery to paging units.

SUMMARY OF THE INVENTION

Accordingly, it is the principal object of the present invention to provide an improved wide area radio paging system and method which provides efficient wide area message delivery which is simple and convenient to users of paging units.

It is another object of the present invention to provide an improved wide area radio paging system which provides high total system message capacity, and variable system message capacity on a regional basis.

It is a further object of the present invention to provide an improved wide area radio paging system in which a user may be automatically notified when the unit has entered the coverage area of a new regional transmission system, thereby enabling the user to submit information related to the new regional transmission system to the wide area radio paging system.

It is still a further object of the present invention to provide an improved wide area radio paging system in which the paging unit may automatically submit information related to the new regional transmission system to the wide area radio paging system after the unit has entered into the coverage area of a new regional transmission system.

It is yet another object of the present invention to provide an improved wide area radio paging system in which the user or paging unit can provide information to the system to update the system as to the paging unit's location without any knowledge of the coverage areas associated with the system or its transmitter sites.

It is another object of the present invention to provide an improved wide area radio paging system in which the user can have messages automatically retransmitted for periods of time when the radio paging unit might have seen unable to receive messages.

It is another object of the present invention to provide an improved wide area radio paging system which can be readily integrated into one-way or two-way radio paging systems.

Briefly described, the present invention embodies a system for providing page message to paging units over a wide area having multiple regional transmission systems. Each transmission system has one or more transmitter sites in a predefined geographic coverage area in the wide area for sending messages in coded radio transmissions to paging units. The system includes a routing controller to route page messages received by the system to each paging unit through one of the transmission systems registered to the paging unit in accordance with a routing database stored in memory of the routing controller. Each transmission systems sends page messages received from the routing controller to the paging units, and sends periodically a system message having at least a unique regional system identifier for the transmission system to any paging units in reception range of its transmitter sites. Each of the paging units receives page messages from the transmission system registered for the paging unit when the paging unit is located in the coverage area of that transmission system, and receives system messages of at least one transmission system when located in the associated coverage area of the transmission system. A paging controller in each paging unit determines when the paging unit receives a system message sent by a transmission system different from the transmission system registered for the paging unit, which indicates the paging unit has roamed (moved) into the coverage area of another transmissions system. The regional system identifier of the transmission system registered to each paging unit is stored in memory of the paging unit, and is used for comparison with received system messages. The paging controller of each paging unit in response to receiving a system message of another regional transmission system accesses a control input unit of the routing controller to either manually, semi-manually, or automatically send at least information identifying the paging unit and the regional system identifier of the transmission system of the received system message, in order to update the registration of the paging unit in the system. In response, the routing controller updates (or re-registers) the registration of the paging unit in the routing database to one of the transmission systems in accordance with the regional system identifier received from the paging unit, and sends a confirmation message to the paging unit having the regional system identifier of the updated transmission system registered for the paging unit. The confirmation message is routed through the transmission system having the regional system identifier received by the routing controller from the paging unit. The paging unit receives the confirmation message from the controller, and the paging controller of the paging unit operates responsive to the new regional system identifier as the transmission system registered to the paging unit from which page messages and system messages will be received.

Multiple regional transmission systems may serve different or common geographic coverage areas. Transmission systems having approximately the same geographic coverage area operate on different transmission frequencies, in which one of the transmission systems having approximately the same geographic coverage operates on the common frequency, and geographic coverage areas having a single transmission system operate on the common transmission frequency. Each of the paging units are capable of receiving the system messages and the page messages on the transmission frequency of the transmission system registered to the paging unit. Each of said paging units, responsive to receiving a confirmation message with the first identifier of the updated transmission system, receives the system messages and the page messages on the transmission frequency of the updated registered transmission system. Each regional system identifier may include information identifying the geographic region and the transmission frequency of the transmission system associated with the regional system identifier, such that the paging unit operates to receive system and page messages on the frequency associated with the regional system identifier stored in the memory of the paging unit.

Each of the paging units may record time periods during which the paging unit does not receive, within a predefined interval, the system message of the regional transmission system to which the paging unit is registered. Any such time periods are transmitted to the routing controller when the paging unit accesses the control input unit. In response, the routing controller resends to the paging unit (via the regional transmission system to which the paging unit is registered) any page messages sent to the paging unit during those time periods in accordance with a message database at the controller which stores copies of each message sent to paging units with the time the message was routed.

Each page message received by the routing controller has message data and information identifying one or a group of paging units to receive the message data. A page message, having information identifying a single paging unit to receive the message data, is routed by the controller to one of the transmission systems to which the paging unit is registered in accordance with the routing database. A page message, having information identifying a group of paging units to receive the message data, is routed by the controller to each of the paging units in the group in accordance with the routing database and a group database identifying to the paging units in that group.

The present invention further embodies a method for providing page messages to radio paging units over a wide area through multiple regional transmission systems having the steps of registering each of the paging units to one of the transmission systems, routing page messages to each of the paging units through the transmission system to which the paging unit is registered, sending page messages received by each of the transmission systems to the paging units located in their associated coverage areas, sending a periodic system message from each transmission system having information which uniquely identifies the transmission system to any of the paging units located in their associated coverage area, receiving the page messages sent to each paging unit from the transmission system registered to the paging unit, receiving system messages at each paging unit when the paging unit is located in the coverage area of at least one of the transmission systems, re-registering each paging unit to a different one of the transmission systems from the transmission system the paging units is registered when the paging unit receive at least one of the system messages sent from one of the transmission systems different from the transmission system to which the paging unit is registered, and sending to the paging unit the transmission system to which the paging unit is re-registered.

The method may further comprise recording one or more time periods in which the paging unit does not receive within a predefined interval the system message of the transmission system to which the paging unit is registered, storing a message database having copies of each page message routed to each of the paging units with the time information that the page message was routed, and resending any page messages routed to the paging unit during the time periods in accordance with the message database.

The system and method according to the present invention operates on the basis of regional transmission systems, and the user of a paging unit does not require knowledge of the geographic coverages of such regional transmission systems. Paging units are able to move freely within areas covered by regional transmission systems and between areas covered by different transmission systems. Automatic detection of movement between regional transmission systems is provided to users through reception of system messages by the paging units. The movement of each of the paging units between regional transmission systems may then be communicated to the routing controller via the control input units. This communication represents information identifying: the affected paging unit, the new transmission system that the paging unit is to be associated with (regional system identifier), and information describing periods of time when the paging unit might have been unable to receive messages. Automatic or manual (user facilitated) communication may be provided between paging units and the controller. When an automatic communication mechanism is not available or inoperative, the paging unit provides a perceptible indication to the user for intervention and completion of communication. In case telephonic communication is required, a telephone number is automatically obtained for telephonic communication appropriate for this regional transmission system. The telephone number may be an access number of a control input unit is included in the system message received from the transmission system whose coverage area the paging unit has moved into. Communication of region changes to the radio paging system is confirmed by a confirmation message sent to the paging unit. The routing controller will also retransmit, via the new regional transmission system; messages which were sent to the paging unit during periods of time when the paging unit might have been unable to receive messages. Henceforth, until a communication of a new region change is received by the message routing controller, all messages received by the radio, paging system for delivery to this paging unit will be routed to this regional transmission system for broadcast to the paging unit.

The system and method of the present invention preferably uses one-way radio paging units, but may be integrated with two-way radio paging units. Further, the two-way radio paging units can also be used in regional transmission systems where only one-way communications facilities are provided. This may be facilitated by transmitting information (such as a defined bit) in the system message to all radio paging units in a region to indicate whether two-way paging facilities are available or only one-way communications facilities are available.

BRIEF DESCRIPTION OF THE DRAWINGS

The foregoing objects, features and advantages of the invention will become more apparent from a reading of the following description in connection with the accompanying drawings, in which:

FIG. 6 is the data structure of the Regional System ID (RegID) of the system message of FIG. 5, where the RegID is composed of a System ID (SID), a Regional ID (RID) and a Frequency ID (FID), and an example of a RegID and the bit masks which may be used to obtain the SID, RID and FID of the RegID;

FIG. 14 is the data structure for the array used by the radio paging unit of FIG. 9 to store time periods of no service to the radio paging unit;

FIG. 16 is the data structure for the control input information which is input manually by a user via telephonic means to one of the control input units of the radio paging system of FIG. 1;

FIG. 17 is the data structure for the Routing Database in memory of the message routing controller in the radio paging system of FIG. 1 for routing messages to paging units via their registered regional transmission systems;

FIG. 18 is the data structure for the Message Database in memory of the message routing controller in the radio paging system of FIG. 1 for storing messages routed and information about such messages;

DETAILED DESCRIPTION OF THE INVENTION

Figure 1:
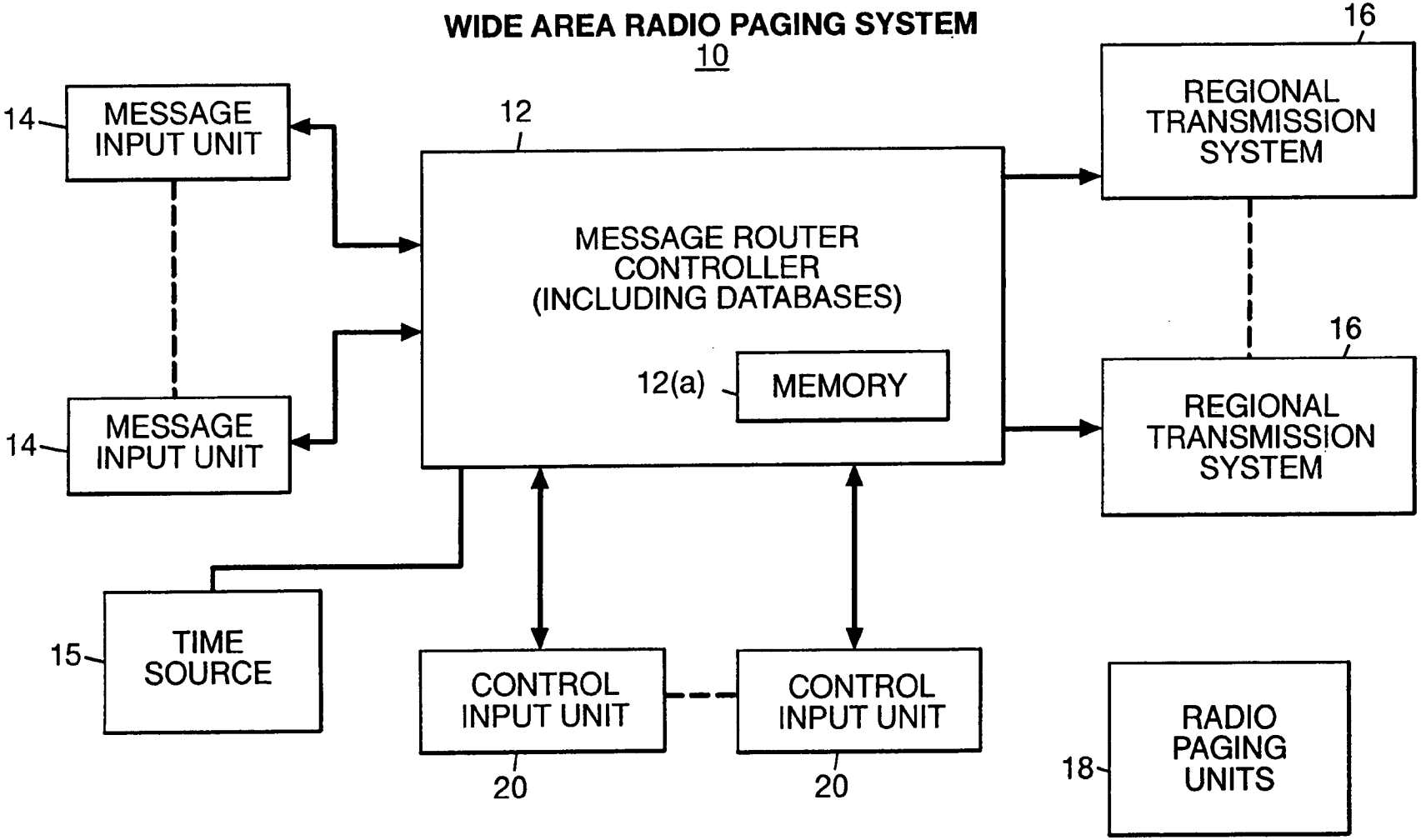
FIG. 1 is a block diagram showing the wide area radio paging system in accordance with the present invention.

Referring to FIG. 1, the wide area radio paging system 10 of the present invention is shown having a message routing controller 12 (message router) which routes incoming page messages received via message input units 14 to regional transmission systems 16 for transmission to radio paging, units 18. The routing controller 12 may be a programmed computer or other microprocessor-based device having memory 12(*a*). Each of the regional transmission systems 16 represents one or more transmitter sites for sending page messages to radio paging units 18 and means for encoding, formatting, and sending page messages received from the message routing controller 12 over such sites. Regional transmission systems 16 may be similar to a typical paging service provider in their capability to encode page messages and control the transmission of encoded messages over one or more transmitter sites. The message input units 14 each represent an interface to the routing controller 12 for receiving page messages. System 10 also includes the radio paging units 18, which may be similar to typical pagers or other page message receiving devices. Each of the radio paging units 18 is associated with a user and thus may travel freely in or between the coverage areas (regions) associated with the regional transmission systems 16. The radio paging units 18 are shown as a block in FIG. 1 for purposes of illustration.

Figure 2:
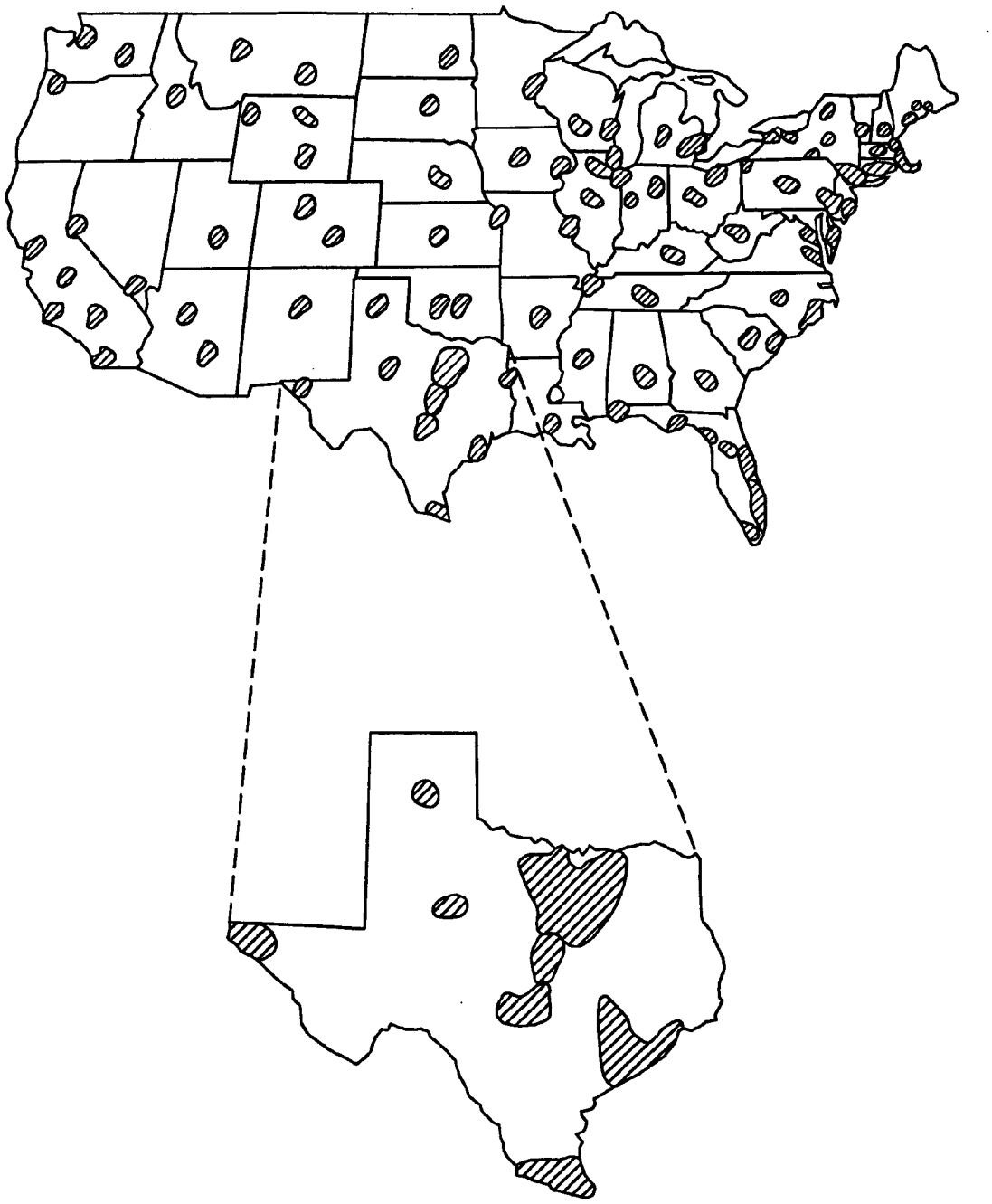
FIG. 2 is a map of the contiguous United States of America showing an example of the coverage areas of the regional transmission systems in the wide area paging system of FIG. 1.

An example of the geographic coverage areas for the regional transmission systems 16 is shown in FIG. 2. System 10 may be considered as comprising one or more geographic regions of radio paging coverage. Each regional transmission system 16 may cover a number of continuous or discontinuous geographic areas.

Each paging message received by a message input unit 14 includes message data and message input identification information for identifying the radio paging unit or group of radio paging units 18 to receive the page message. The routing controller 12 routes the paging message to the regional transmission system 16 with which each radio paging unit is registered in accordance with a database stored in memory 12(*a*) of the routing controller, referred to as the Routing Database. A Group Database is also provided in memory 12(*a*) to associate input identification information in a page message, referencing a group of radio paging units, to their individual unique identifications, which are referred to herein as UnitIDs. The delivery of an incoming page message to a single radio paging unit 18 via a regional transmission system 16 is referred to hereinafter as a unit message. The delivery of an incoming message to a plurality of radio paging units 18, via one or more regional transmission systems 16, is referred to hereinafter as a group message. Further stored in memory 12(*a*) is a Message Database having for each message routed a row (or record) with information representing at least the UnitID of the radio paging unit 18 to which the message was sent, the message data, and the time the message was sent (routed) to the regional transmission system 16. These three databases will be described in more detail later in connection with FIGS. 17–19. A time source 15, such as a clock, provide signals to the routing controller 12 representing the current system time. The time source 15 is used by the routing controller 12 to provide the time each message was sent. Time source 15 may be external or part of the controller 12, and may be synchronized by GPS, WWB, WWV, or other time signaling means.

Each radio paging unit 18 at any given moment of time is registered with one of the regional transmission systems 16 per the Routing Database. Radio paging units 18 may re-register to a different regional transmission system 16 via communication through one of the control input units 20, which represents a device which can receive control input information from radio paging units, such as through a telephone-based connection. The control input units 20 enable users to affect re-registration, request message retransmission, or perform other functions. Each control input unit 20 may represent a programmed microprocessor-based device having a telephone-based communication interface, such as a modem or DTMF decoder. Registration is defined herein as the process of associating a radio paging unit 18 with a regional transmission system 16 for the delivery of radio paging messages. Registration determines which of the regional transmission systems 16 that incoming messages will be routed to by the message routing controller 12 for delivery to radio paging unit(s) 18. Control input information sent from radio paging units 18 to one of control input units 20 represents information to affect such registration or re-registration and to request message retransmission, as will be described later in connection with FIGS. 15–16. The message input unit 14, control input unit 20, and routing controller 12 may be separate components, or integrated into a single programmed computer-based device. Further, one or more of the message input units 14 and control input units 20 may be in the same location as the routing controller 12, or may be remote from the controller, but in data communication therewith by telephone, cable, satellite, or other communication means.

Figure 3:
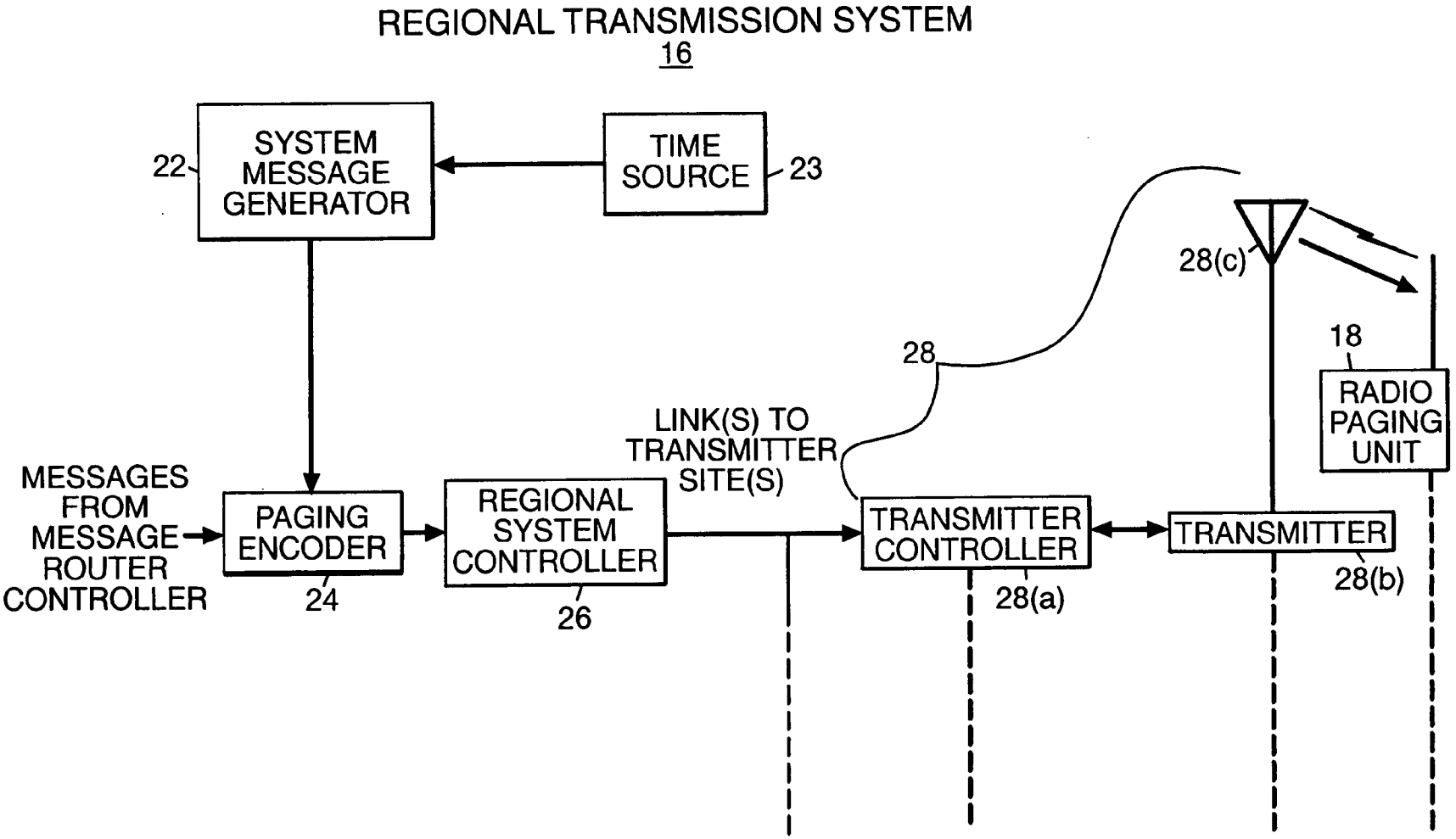
FIG. 3 is a block diagram showing one of the regional transmission systems in the wide area radio paging system of FIG. 1 with one of the radio paging units of the wide area radio paging system in reception range of the regional transmission system.
Figure 4:
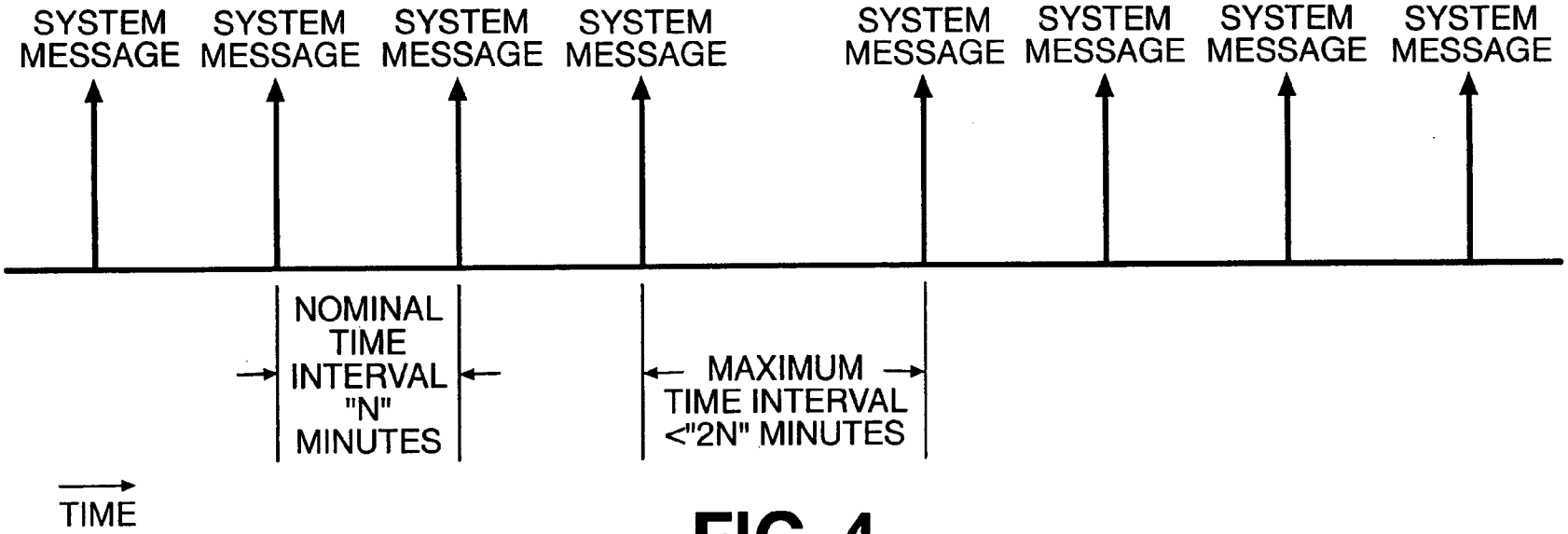
FIG. 4 is a diagram showing the timing of system messages which are broadcast by each of the regional transmission systems of FIGS. 1 and 3 to the radio paging units in their coverage areas, where the transmission of each broadcasted system message is indicated by an upright arrow.

Referring to FIG. 3, a block diagram of one of the regional transmission system 16 is shown. The regional transmission system 16 includes a system message generator 22, a paging encoder 24, and a regional system controller 26 linked to one or more transmitter sites 28 represented by transmitter controller 28(*a*), transmitter 28(*b*), and antenna or tower 28(*c*), which broadcasts coded radio transmission signals to zero or more radio paging units 18 residing within the prescribed coverage region for that regional transmission system. The regional transmission systems 16 each periodically broadcast a system message to radio paging units 18. The system message generator 22 provides for the generation of these periodic messages. The system message generator 22 generates and submits system messages to the paging encoder 24 in accordance with a specified nominal time interval N, as shown in FIG. 4. The actual transmission interval between system messages could be more or less than this nominal value N. The nominal maximum time interval between transmissions should be less than 2N minutes, although other defined maximum values may be used. The nominal time interval N needs only to be often enough to provide reasonable responsiveness to the detection of changes in regional transmission systems and service availability by radio paging units 18. For example, N may be equal to 5 minutes. The regional transmission systems 16 are generally located remote from the routing controller 12.

Figure 5:
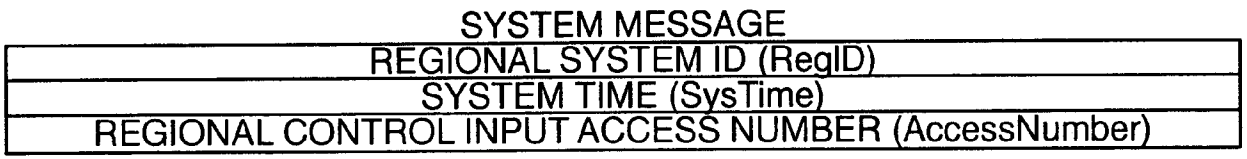
FIG. 5 is the data structure of the system message transmitted by each of the regional transmission systems of FIGS. 1 and 3.

The composition of each of the system messages is shown in FIG. 5. The system message generator 22 is configured for the value of the regional system ID (RegID) assigned to the regional transmission system in which it is used. Each regional transmission system 16 has a unique RegID value. Similarly, a regional control input access number (AccessNumber) is configured into the system message generator 22 based on the appropriate dial access number for the region to gain access to at least one of the control input units 20 (FIG. 1). The system time (SysTime) field of the system message is set by the system message generator 22 for each system message to reflect the approximate time of transmission of the system message in terms of system time. The system message generator 22 can derive this time based on inputs to the generator from a time source 23, such as GPS, WWV, WWVB, network time clocks, or other types of time sources. SysTime may be produced based on relative or absolute timebase systems.

The paging encoder 24 of the regional transmission system 16 accepts system messages from the system message generator 22, and radio paging messages received from the routing controller 12 via land (wires), satellites, networks, other communication means. It encodes these messages in accordance with the radio paging protocol, such as POCSAG, and formatting rules associated with the particular radio paging protocol selected for use in the radio paging system. The present invention is not limited to the use of any particular radio paging protocol. The encoded messages are then submitted to the regional system controller 26. The regional system controller 26 accepts encoded messages from the paging encoder 24, and formats them into data appropriate for conveyance over the one or more link systems used to connect the system controller 26 to one or more transmitter sites 28. Such link systems may be land or satellite-based, and may be as described in U.S. patent application Ser. No. 09/089,106, filed Jun. 2, 1998 by the same inventor. The regional system controller 26 may also generates appropriate control signals to remotely control the transmissions of the one or more transmitter controllers 28(*a*) and transmitters 28(*b*) associated with the regional transmission system 16 at remote transmitter sites 28. Working cooperatively with the regional system controller 26, each transmitter controller 28(*a*) decodes the data received from the regional system controller 26 and produces appropriate control and modulation signals for the transmitters 28(*b*) to produce the requisite coded transmissions for the radio paging units 18. Antenna 28(*c*) broadcasts the coded transmissions to any radio paging units 18 currently residing within the prescribed region for the regional transmission system 16. The operation of the paging encoder 24, regional system controller 26, and transmitter sites 28, of the regional transmission system may be in accordance with typical regional transmission systems for broadcasting to paging units over one or more transmitter sites.

Referring to FIGS. 5–8, the system messages transmitted by regional transmission systems 16 and received by radio paging units 18 will be described in further detail. System messages uniquely identify the regional transmission systems 16 used to broadcast coded transmissions to radio paging units 18. System messages also provide other system related information to radio paging units 18. The system messages are preferably sent as radio paging messages addressed to all radio paging units 18, but may also be embedded within the radio paging protocol and formatting information, such as often used by typical regional transmission systems. As stated earlier, each of the system messages includes three fields: Regional System ID (RegID), System Time (SysTime) and Regional Control Input Access Number (AccessNumber). The Regional System ID (RegID) is the field which uniquely identifies the regional transmission system 16 broadcasting the system message. Each regional transmission system 16 is assigned a unique RegID. The RegID is indicative of the transmission system sending the coded transmissions being received by radio paging units, rather than any particular geographic area. This differs significantly from other known prior art wide area paging systems which focus on the determination of geographic location or identification of the nearest transmitter. SysTime is the approximate time, in units of system time, that the system message was transmitted. SysTime is transmitted to enable radio paging units 18 to synchronize their internal clocks (denoted by numeral 46 in FIG. 9) to a common timing system for recording service availability times. The Regional Control Input Access Number (AccessNumber) field is used by the regional transmission system 16 to communicate an appropriate telephone number for that region which can be used by users to one or more of access control input units 20 (FIG. 1). Optionally, other information may be included with the Regional Control Input Access Number, such as information as to whether two-way receiver facilities are available in the region, the name of the region, or other region specific information. The AccessNumber need only be appropriate for the region, and it need not be local. For example, a common toll-free "800" number might be used as the AccessNumber for all regions in a country, or a distinct local telephone number might be used as the AccessNumber for each regional transmission system 16 in the radio paging system 10.

As shown in FIG. 6, the RegID of the system message comprises three variable width sub-fields: System ID (SID), Regional ID (RID) and Frequency ID (FID). For example, the width of each sub-field may be defined by the ones in three mask values SIDMask 52, RIDMask 54 and FIDMask 56, respectively. The mask values may be stored in the radio paging units. SID, RID, and FID values may also be dynamically communicated as separate fields to the radio paging units 18 by incorporating them into the system message data structure. The SID uniquely defines the radio paging system 10, and enables radio paging units 18 to ignore system messages received on the same frequency from regional transmission systems of unrelated radio paging systems as the radio paging units move about over wide geographic areas. The RID uniquely defines a geographic region, independent of what the geographic coordinates might be, for any given radio paging system defined by SID. The FID uniquely defines the frequency used for any given region, defined by RID, for any given radio paging system, defined by SID, where the FID value can be translated into a discrete radio frequency based on common tables stored in all radio paging units 18. Although preferably the FID is a coded value translated into a radio frequency by the radio paging units 18, the FID valve may be a larger field in the system message which represents all, or part, of the actual frequency value.

Figure 7:
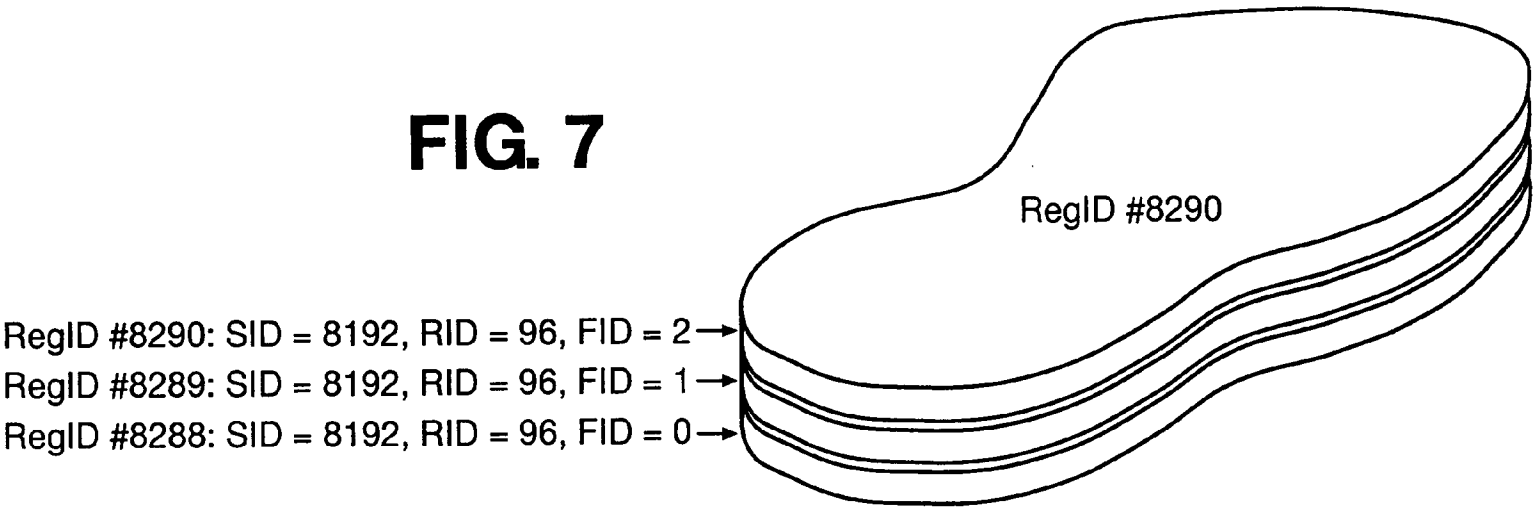
FIG. 7 is a diagram showing an example of multiple geographically overlapped regional transmission systems in terms of their RegID's for the same SID and RID, but different FID's.
Figure 8:
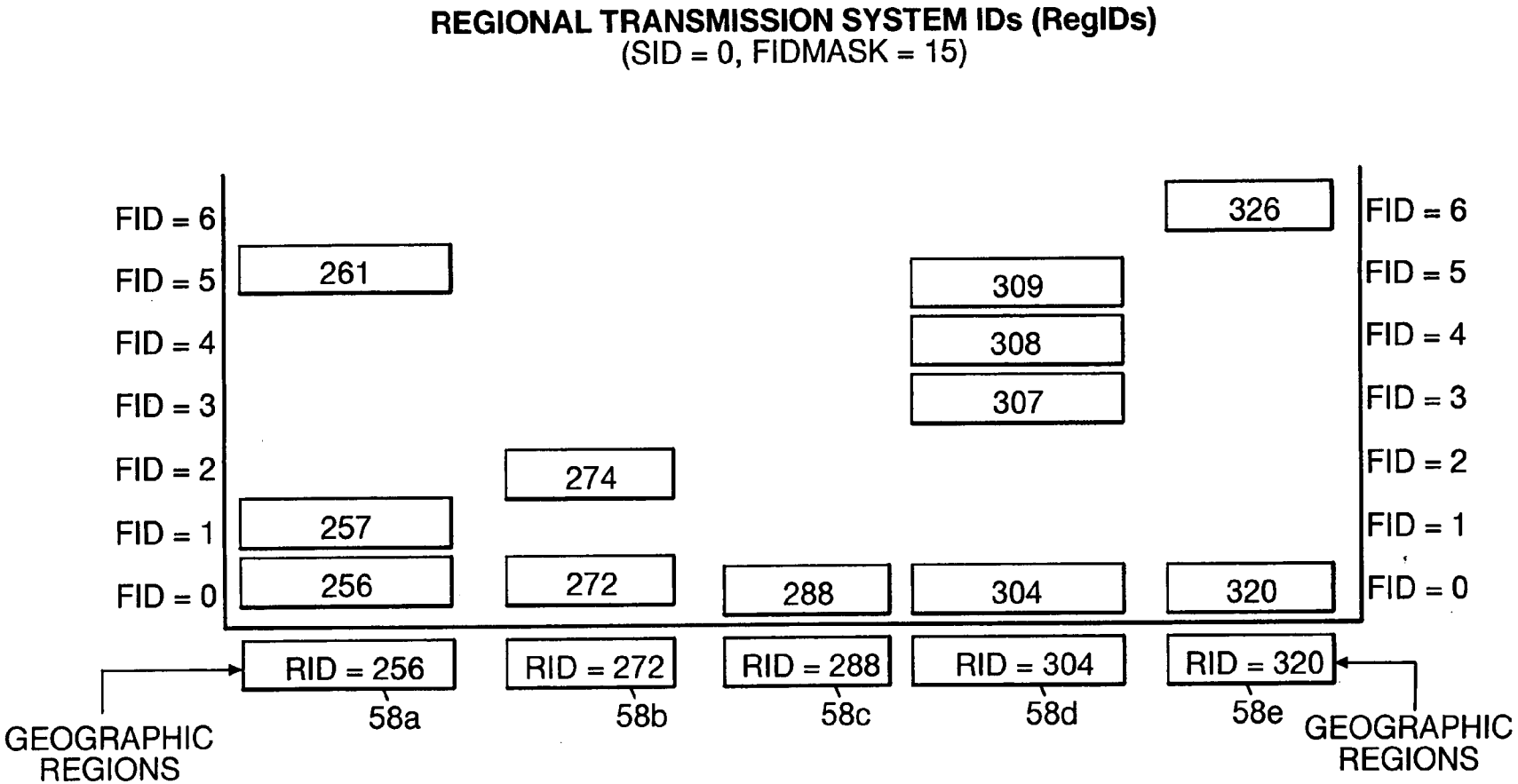
FIG. 8 is another diagram showing an example of multiple geographically overlapped regional transmission systems in terms of their RegID's for the same SID and different RID's and FID's.

The use of differing FID values for common RID values allows wide area radio paging system 10 to support multiple regional transmission systems over common geographic areas to provide increased system message capacity in high traffic regions. This is illustrated for example in FIG. 7 for three regional transmission systems 16 operating over the same geographic area on three different frequencies: RegID #8288 (SID=8192, RID=96, FID=0), RegID#8289 (SID=8192, RID=96, FID=1) and RegID #8290 (SID=8192, RID=96, FID=2). As graphically depicted in this figure, three regional transmission systems 16 are stacked one on top of the other. All three regional transmission systems 16 have a common SID and RID, but differing FID's represented by 0, 1 and 2. Each additional FID for a region introduces an additional channel of message capacity for the region. Each geographic region served by the wide area radio paging system 10 utilizes at least one RegID with an FID=0. In other words, in each region (RID) of a given radio paging system (SID) there must be regional transmission system 16 using frequency 0 (FID=0). This assures that there is common frequency across all regions of the wide area radio paging system 10. The use of additional FIDs with non-zero values is optional and may be based on additional system message capacity needed for a region. This is illustrated in FIG. 8 which shows an example of the wide area radio paging system 10 with five regions, each having various RegIDs and multiple FIDs in use in some regions. All RegIDs belong to SID=9, meaning that all regional transmission systems are a part of the same wide area radio paging system. Five RIDs 58*a*, 58*b*, 58*c*, 58*d*, and 58*e* are used, one each with a FID=0. Except for RID 58*c*, the other RID's include various RegID's with various FID values, selected from the group of FID=1 to 6, where each RegID having the same RID has equivalent geographic coverage. For example, in RID 58A, three transmission systems 16 are present where each system has a different frequency represented by FID=0, 1 or 5.

Figure 9:
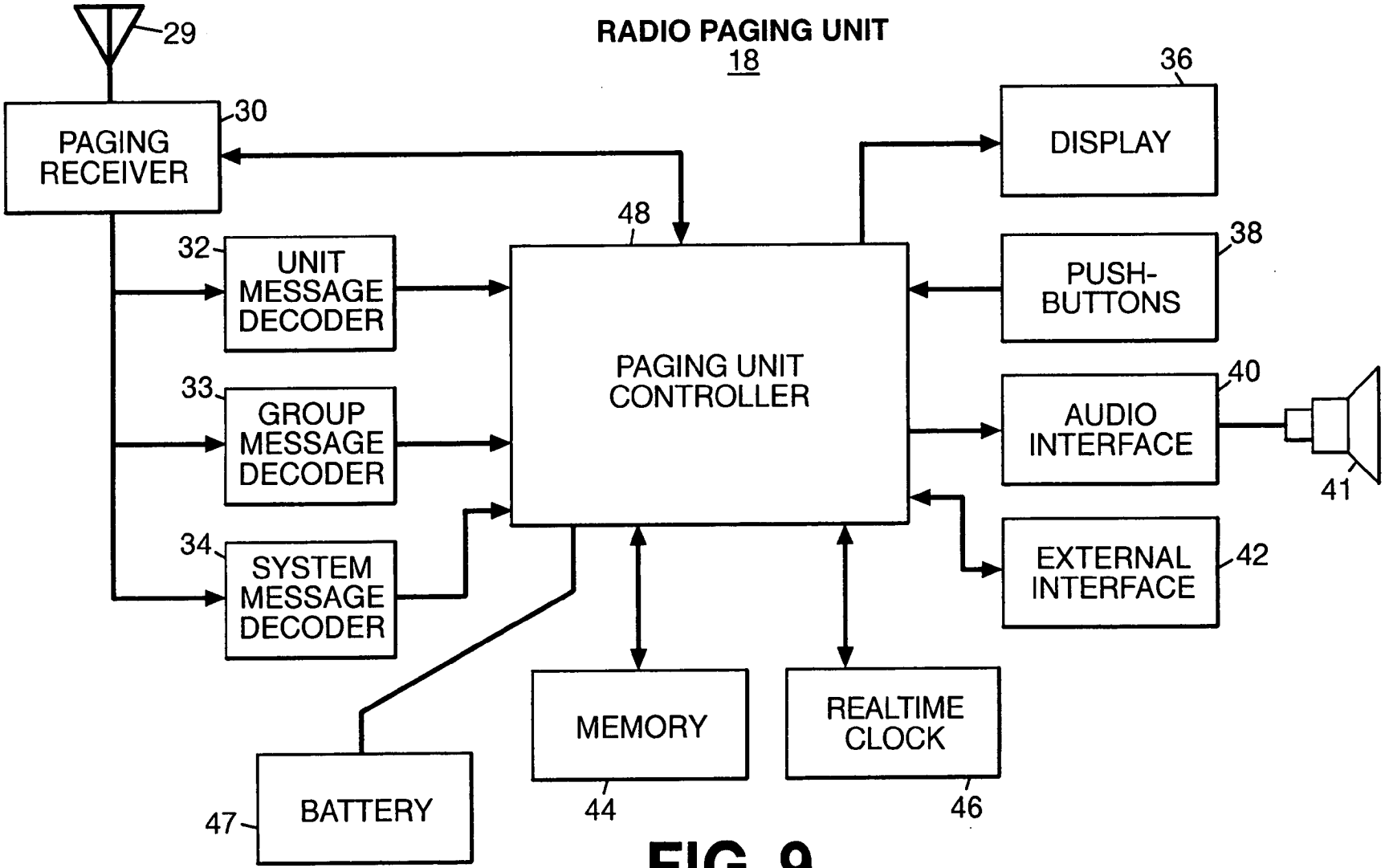
FIG. 9 is a block diagram showing one of the radio paging units in the wide area paging system of FIG. 1.

Referring to FIG. 9, a block diagram of one of the radio paging unit 18 is shown. The radio paging unit 18 includes a paging receiver 30 for the reception and demodulation of coded transmissions broadcast by the regional transmission systems 16, and a unit message decoder 32, group message decoder 33 and system message decoder 34 for decoding the different types of messages received from the paging receiver 30. A paging unit controller 48 controls the operation of the radio paging unit 18 in accordance with stored programming (software) in memory of controller 48 or memory 44, and may represent a microprocessor-based device. Information from the paging unit controller 48 may be outputted to a display 36 or an external interface 42. One or more pushbuttons 38 are provided to enable the user to interface with the radio paging unit 18. Pushbuttons 38 may be typical of a pager. An audio interface 40 to a speaker 41 is provided to enable the paging unit controller 48 to output information as DTMF or other audio-based signals. A real-time clock 46 provides a source of timing for the paging unit controller 48. A battery 47 may also be provided in the radio paging unit 18 to provide a source of power to the unit. With the possible exception of the external interface 42, all of these elements 30–48 are present in typical radio paging units. As such, the present invention can be readily incorporated into existing designs of radio paging units by adding and changing certain software, such as in controller 48, to make the units operate in accordance with the present invention.

The paging receiver 30 receives, via an antenna 29, the coded transmissions broadcast from the one or more transmitters of the regional transmission system 16 in range of the unit, i.e., when the paging unit is in the coverage area or region of the transmission system. The paging receiver 30, operating under the control of the paging unit controller 48, may be single frequency or multifrequency. To prolong battery 47 life, the paging receiver 30 may be pulsed on and off consistent with the operating requirements of the radio paging protocol used for system 10.

Operating in accordance with the radio paging protocol used for the radio paging system 10, the unit, group and system message decoders 32–34 provide for the decoding of coded messages contained in the demodulated data received from the paging receiver 30. The message decoders 32–34 monitor the demodulated data from the paging receiver 30 for messages which match their respective addresses. All system message decoders 34 in all radio paging units 18 of system 10 are configured to respond to the same address (System Message Address). The unit message decoder 32 in each radio paging unit 18 is configured to respond to the unique address (UnitID) of the particular radio paging unit. As stated earlier, each radio paging unit 18 has a unique UnitID. The group message decoder 33, in groups of related radio paging units, is configured to respond to the same address (GroupID). The group message decoder 33 of the radio paging unit may respond to one or several different GroupID. When one of the message decoders 32–34 detects a matching address, it decodes the message and passes the message onto the paging unit controller 48 for processing, which is described later in more detail in connection with the flow charts of FIGS. 20–27. Radio paging units 16 may include more than one unit message decoder 32 or group message decoder 33. The single decoder per type shown in FIG. 9 is for purposes of illustration. The radio paging unit 18 behave and operate as typical radio paging units for receiving decoded page messages and reporting them to users.

The system message decoder 34 decodes system messages which are periodically generated by regional transmission systems 16 and addressed to all radio paging units 18. These system messages enable radio paging units 18 to detect when they have entered the coverage area of another regional transmission system, i.e., to determine whether they are registered for radio paging service from the appropriate regional transmission system 16 and whether they are receiving radio paging service at all. When system messages are received, they are fed to the paging unit controller 48 for processing. The paging unit controller 48 expects to receive system messages on a periodic basis from the regional transmission system 16 that it is currently registered to. The periodic interval is described in FIG. 4 as nominally being N minutes, but not to exceed 2N minutes. The regional transmission system 16 sending the system message is identified by the Regional System ID (RegID) contained within the system message, as shown in FIG. 5. The RegID expected by the paging unit controller 48 is stored in memory 44 of the radio paging unit as CurrRegID. The routing controller 12 (FIG. 1) delivers unit and group messages to the regional transmission system 16 of registry, which reflects the CurrRegID stored in memory 44 of the radio paging unit. If 2N minutes pass without the paging unit controller receiving a system message with the appropriate RegID, then the paging unit controller concludes that the paging unit 18 is not receiving service. Further, even though system messages may be received by the radio paging unit, if the RegID of the system message does not match the stored CurrRegID value, then the radio paging unit is not receiving service. The receipt of system messages by the radio paging unit 18 with a different RegID indicates that the radio paging unit is listening to broadcasts from a regional transmission system 16 that is not receiving messages for delivery to the radio paging unit, and thus, the unit cannot be receiving radio paging service.

The radio paging units 18 are each registered in the wide area paging system 10 for service with a particular regional transmission system 16, denoted by its particular RegID, and retain this value as its CurrRegID in memory 44 until they re-register for association with a different regional transmission system denoted by the new RegID associated with that regional transmission system. Radio paging units 18 may, re-register to have associations with other regional transmission systems 16 by communication with the control input units 20. Radio paging units 18 automatically detect when re-registration is required by monitoring system messages broadcast by the regional transmission systems 16 with the same SID value as the stored CurrRegID. Specifically, if the RID of the RegID of a received system message differs from the RID of the RegID stored as the CurrRegID, the radio paging unit 16 will attempt to re-register with the routing controller 12 by accessing one of the control input units 20. Further, a paging unit having a CurrRegID with a FID greater than zero may reset the frequency of its receiver to that in accordance with FID equal to zero if it fails to receive a system message with CurrRegID within a predefined interval. Thereafter, if the paging unit 16 starts receiving a system message in which the RID of system message matches the RID of CurrRegID in the unit, but the FID's differs, the radio paging unit's will retune its receiver 30 to the frequency corresponding to the FID of the CurrRegID.

Figure 10:
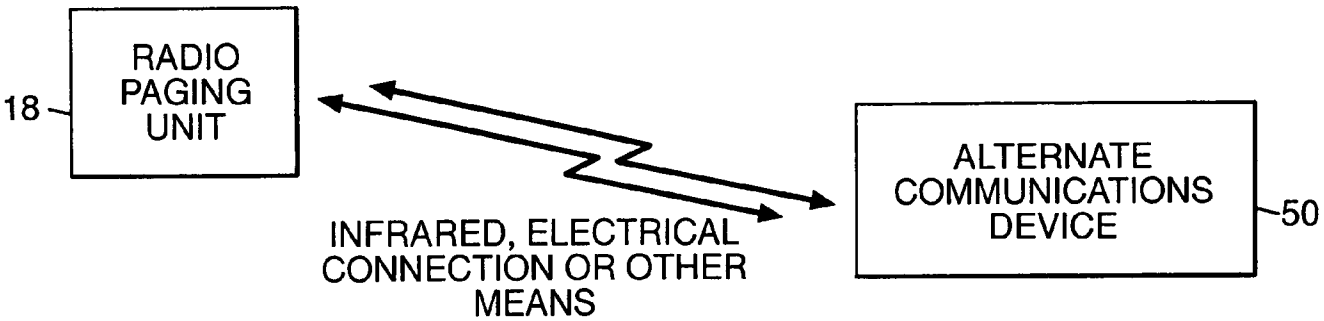
FIG. 10 is a block diagram showing an alternate communications device for communication with the external interface of the radio paging unit of FIG. 9.

When re-registration is required, the radio paging unit 18 will attempt automatic communication of control input information with a control input unit 20 using an external alternate communications device 50, as shown in FIG. 10, if the radio paging unit is configured for use with such a device and the device is available, otherwise the radio paging unit will alert the user with the necessary control input information for him or her to affect a manual re-registration through one of the control input units 20. This alternative communications device 50 represents any external automatic means for providing information from the external interface 42 of the radio paging unit 18 to the input control unit 20 of the routing controller 12 (FIG. 1). For example, the alternative communications device 50 may be a land or cell phone coupled to an interface for receiving signals from the external interface 42 of the radio paging unit 18. The interface of the alternative communication device may be capable of receiving signals from the external interface 42 by optical (such as infrared), electrical (such as a cable) connection, or other signaling means.

The external interface 42 of the paging unit may be an integral (internal) two-way paging transmitter in the paging unit used by the paging unit for two-way paging. Such a paging unit would also operate in regions lacking two-way receiving capability for registration through semi-automatic or manual registration described below.

Re-registration when facilitated manually by the user without the alternative communications device 50 is performed via a telephone connection to the control input unit 20. This connection and transmission of control input information to the control input unit are carried out by the user pressing numbers of the telephone pad in accordance with control input information shown on display 36, or semiautomatically by such information being audible produced in DTMF or other audio-signaling to the telephone's mouthpiece by the paging unit controller 48 via audio interface 40 via speaker 41. Re-registration is described in more detail later below.

Figures 11, 15:
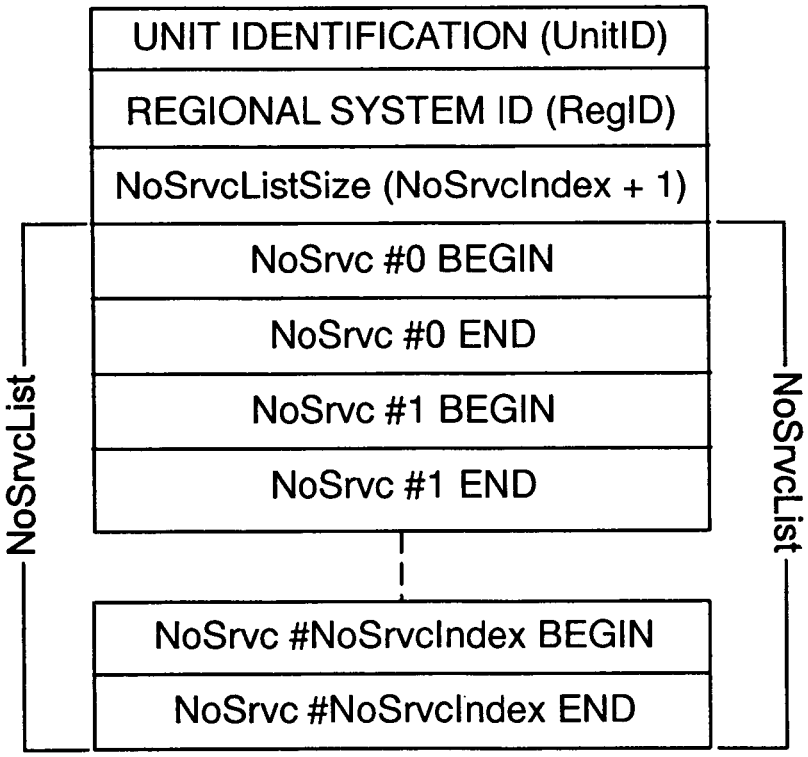
FIG. 11 is the data structure of a confirmation message sent-by the message routing controller in the system of FIG. 1 to a radio paging unit to confirm the radio paging unit re-registration with a new regional transmission system.
FIG. 15 is the data structure for the control input information which is input automatically or semiautomatically to one of the control input units of the radio paging system of FIG. 1.

The routing controller 12 confirms re-registration by sending a confirmation message, shown in FIG. 11, as a unit message to the re-registering radio paging unit. In the confirmation message, the radio paging system 16 can instruct the radio paging unit 18 to set its CurrRegID to the same RegID value as communicated to the routing controller 10 from the paging unit, or to set its CurrRegID to the RegID of a different regional transmission system on a different, specified frequency, distributing page message traffic within the same geographic region. This can increase total system capacity and traffic load distribution across frequencies on a region-by-region basis.

As stated earlier, there are three ways to re-register each of the radio paging units 18, under the control of the paging unit controller 48. These methods include: (1) automatic re-registration via the external interface 42 and external alternate communications device 50 (or alternatively via a two-way paging transmitter if the paging unit is a two-way paging unit), (2) manual re-registration via the display 36 and pushbuttons 38 in conjunction with telephonic means, and (3) semiautomatic re-registration via the display 26, the pushbuttons 38 and the audio interface 40 in conjunction with telephonic means.

Using automatic re-registration, the radio paging unit is connected to the external alternate communications device 50 (FIG. 10) via the external interface 42 (FIG. 4) through infrared light, radio means, electrical connection or other means. When the paging unit controller 48 determines that re-registration is required, the paging unit controller 48 will attempt to establish a connection to the alternate communications device which has the ability to communicate information to the control input units of the radio paging system. If the connection attempt fails, the paging unit controller 48 will fall back to manual or semiautomatic re-registration methods. If the connection attempt succeeds, the paging unit controller 48 will send the control input information defined in FIG. 15 to the alternate communications device 50 for conveyance to a control input unit 20 (FIG. 1). The alternate communications device 50 will return, via the external interface 42, a result code reflecting the success or failure of the communications attempt. If the result is success, re-registration is complete, else the paging unit controller will fall back to manual or semiautomatic re-registration methods. If the paging unit 18 provided two-way paging, the above procedure would be the same, except instead of the alternative communication device, the paging unit would send, via its two-way paging transmitter to a receiver network capable of receiving two-way paging messages, the control input information to the control input unit 20 of the routing controller. A paging unit 18 provided with two-way paging capability may also have an external interface 42 for connecting to an alternative communications device, just as though it were a one-way device. Further, with information, such as a defined bit, in the system message, to indicate whether a receiver network was available in the region, the two-way paging unit could automatically determine whether re-registration is possible via a two-way receiver network or whether re-registration would have to be accomplished via an alternate communications device, semiautomatic or manual re-registration.

Using manual or semiautomatic re-registration, the paging unit controller 48 will cause the radio paging unit 18 to behave as though a radio paging message had been received, including the perceptible notification of the user through audio, visual and/or tactile means. In responding to the notification, the paging unit controller 48 will cause the display 36 to indicate that re-registration is required. Through an interactive sequence of one or more pushbutton 38 operations in conjunction with one or more display 36 screens, the user will be informed of the Regional Control Input Access Number (AccessNumber), the Unit Identification Number (UnitID) for the radio paging unit, the Regional System ID (RegID) from the system message that it has most recently decoded by the radio paging unit, and the NumberOfHoursToRetransmit (i.e., time period of No Service), as shown in FIG. 16. NumberOfHoursToRetransmit represents the End time of the last entry in a NoSrvc array shown in FIG. 14, minus the first entry (Element #0) of the Begin Time of the NoSrvc array. Entry of information into the NoSrvc array in memory 44 will be described later in connection with the flowchart of FIG. 22. The NumberOfHoursToRetransmit value is use to eliminate the tedium of requiring the user to enter a series of paired entries of Begin and End times from the NoSrvc Array. Although less preferred, the paging unit could display such pair entries, and request the user to manually enter values corresponding to Begin and End times as shown in FIG. 15. Through the interactive sequence, the user would be given the choice of reading the displayed information and manually inputting the information using the telephone DTMF keypad or having the paging unit controller semiautomatically dial the number and/or input the information using the audio interface 40, acoustically coupled via proximity to the telephone mouthpiece, to send DTMF and/or other audio-based signaling via the telephone instrument to the control input unit 20 (FIG. 1). If semiautomatic signaling is chosen, the control input information is that shown in FIG. 15.

To minimize the chances that a user will miss messages while operating outside of the actual coverage area for the regional transmission system 16 that his or her paging unit is registered to, radio paging system 10 provides for the radio paging units 18 to automatically determine the availability of service, and provides for the radio paging system to automatically retransmit messages sent during periods of time when service was determined by the radio paging units not to be available. The radio paging units 18 determine service availability by monitoring the system messages broadcast by regional transmission systems 16 to which the paging units are registered. Specifically, if radio paging units 18 do not receive periodic system messages with the appropriate RegIDs corresponding to their stored CurrRegID value, then the units will enter a No Service condition. If the No Service condition persists for a period of time and the radio paging unit 18 is using a non-zero FID, then the radio paging unit will tune to the FID=0 frequency and look for system messages. The radio paging unit stores No Service periods of time and reports these periods of time, at re-registration, to the radio paging system to cause the system to retransmit messages sent during periods of No Service.

Figure 12:
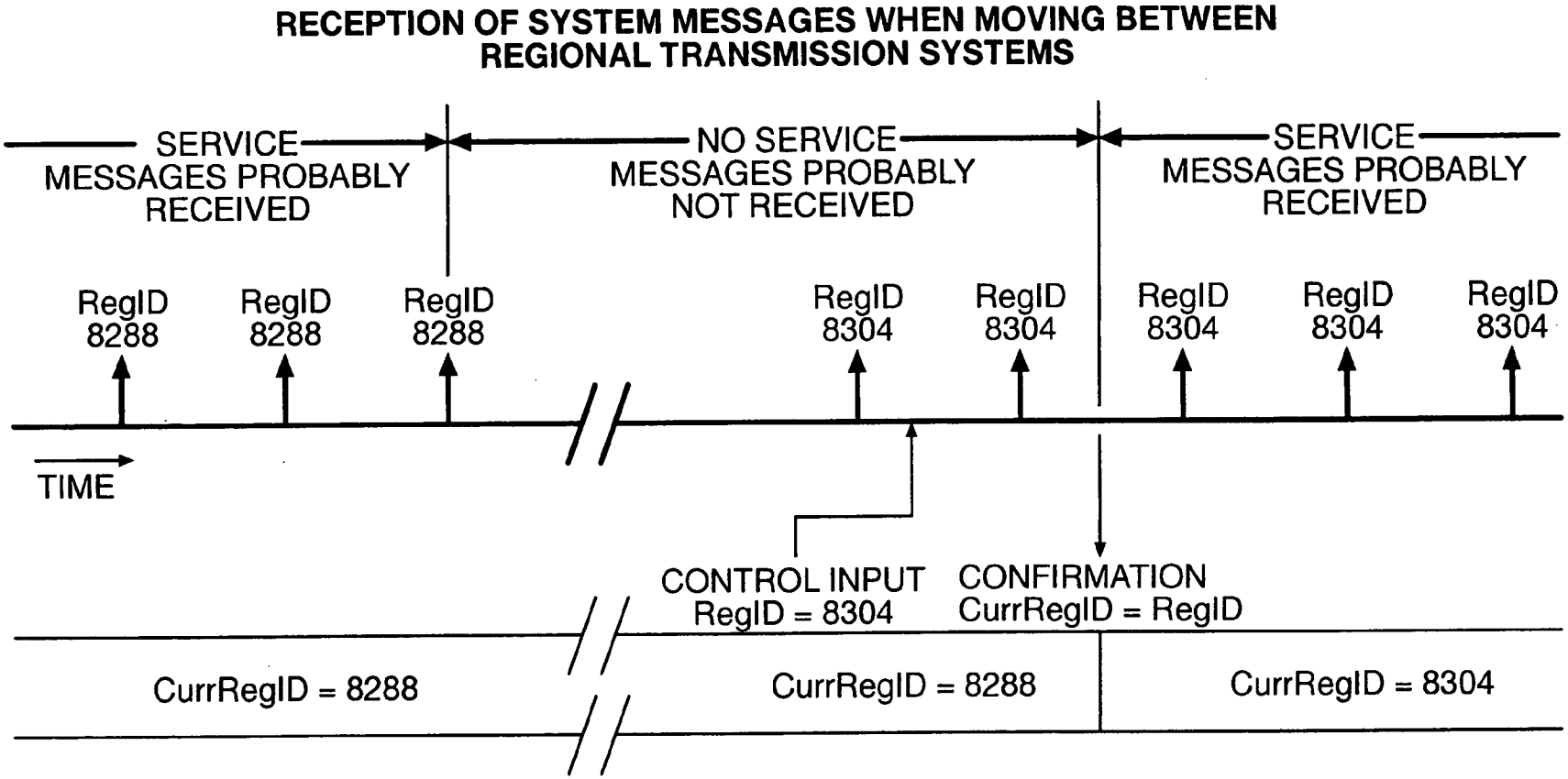
FIG. 12 is a diagram showing an example of the reception of system messages by a radio paging unit of FIG. 9 moving between two regional transmission systems, where the reception of each broadcasted system message is indicated by an upright arrow.

Radio paging units 18 can move from one region to another region of coverage of a regional transmission system. An example of this situation is depicted in FIG. 12. Initially, the radio paging unit was registered with the regional transmission system having a RegID of 8288. The system messages were periodically received by the paging unit controller 48 (FIG. 9) as expected. As the radio paging unit 18 moved out of the region covered by 8288, the receipt of system messages ceased. After a while, as the radio paging unit 18 entered the region covered by the regional transmission system 16 with RegID 8304, the paging unit controller 48 began to receive system messages again. The System ID (SID) portion of the RegID matched the SID portion of the CurrRegID, indicating this regional transmission system 16 was a part of the same radio paging system. The Regional ID (RID) portion of the RegID, however, differed from the RID portion of the CurrRegID, indicating that the radio paging unit 18 had moved to a location served by regional transmission system 16 with a RegID of 8304. Responsive to this sequence of events, the radio paging unit 18 initiated re-registration procedures with a control input unit 20 of the system, registering itself with the RegID of 8304. As can be seen in FIG. 12, the CurrRegID did not change upon re-registration input. CurrRegID changed when registration confirmation was subsequently received by the radio paging unit 18 from the radio paging system 10. Registration confirmation is accomplished by the radio paging system 10 (i.e., controller 12) sending a confirmation message as a unit message to the specifically affected radio paging unit via the new regional transmission system of registry. The composition of the confirmation message is depicted in FIG. 11. The confirmation message conveys a RegID that the radio paging unit is to retain (store) and use. This RegID typically would be that which the radio paging unit 18 specified at the time of re-registration. For traffic load balancing purposes, this RegID might have the FID subfield modified to some other value, causing the radio paging unit 18 to tune to a different frequency and to expect a different RegID when decoding system messages. For message retransmission purposes, the paging unit controller 48 in the radio paging unit records in memory 44 the No Service time period as that time period beginning with the time that the last system message was received with a matching RegID and ending with the time that the confirmation message was received.

Figure 13:
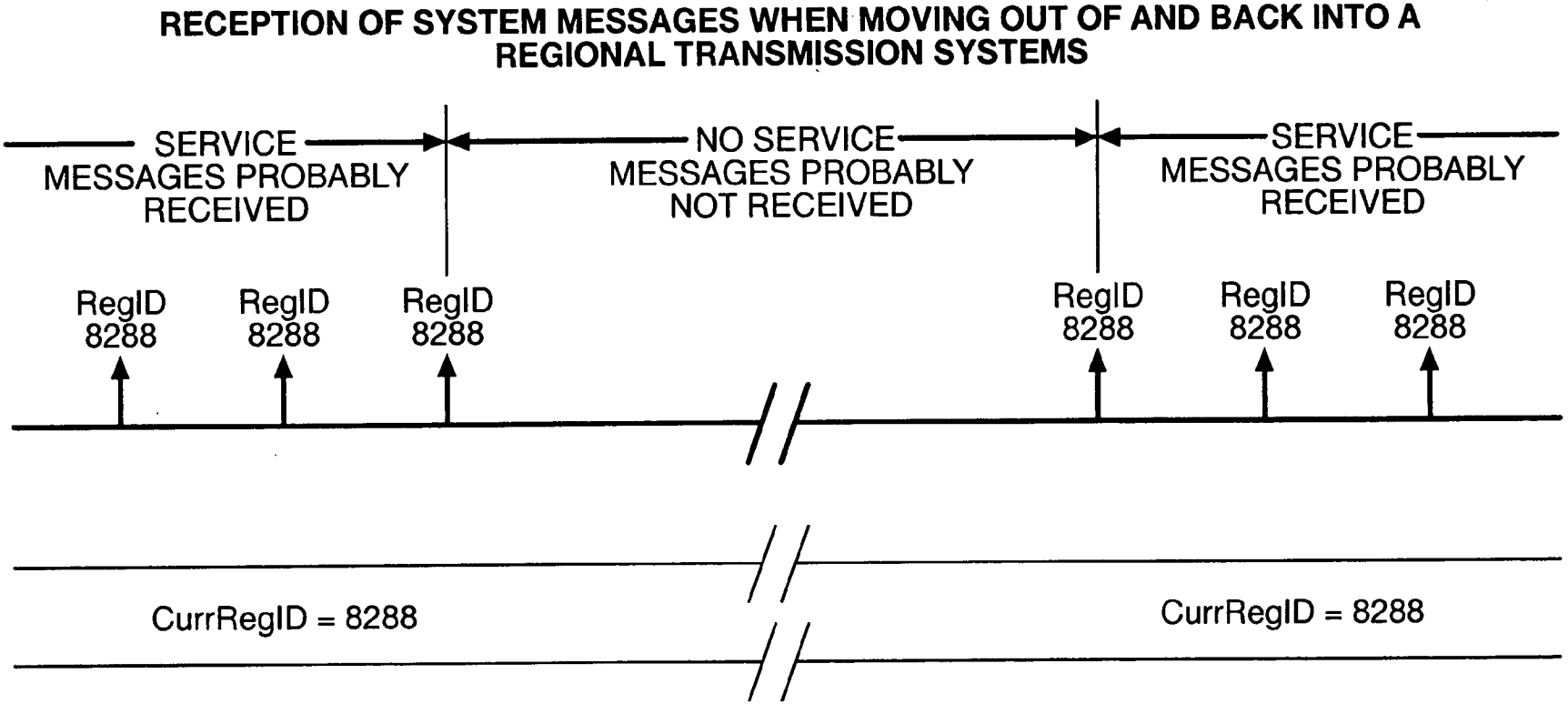
FIG. 13 is a diagram showing an example of the reception of system messages by a radio paging unit of FIG. 9 moving out of and back into a regional transmission system, where the reception of each broadcasted system message is indicated by an upright arrow.

The radio paging units 18 can also move out of, and return back into, coverage for the same region. An example of this situation is depicted in FIG. 13. The radio paging unit 18 is registered with the regional transmission system 16 having a RegID of 8288. Initially, the system messages were periodically received by the paging unit controller 48 as expected. As the radio paging unit 18 moved out of the region covered by 8288, the receipt of system messages ceased. After a while, when the radio paging unit moved back into the region, the paging unit controller 48 again began to receive periodic system messages with a RegID of 8288. As the RegID matched the CurrRegID, no re-registration was required. For message retransmission purposes, the paging unit controller in the radio paging unit recorded in memory 44 the No Service time period as that time period beginning with the time that the last system message was received with the matching RegID and ending with the time that system messages resumed with matching RegID.

The wide area paging system 10 supports the use of multiple geographically overlapping regional transmission systems on different frequencies. The use of multifrequencies is shown in FIGS. 7–8, described earlier, and affects the paging unit controller's processing of system messages. The use of multiple frequencies requires that all regions, at minimum, utilize a RegID with an FID of zero (FID=0). Referring to the FIG. 12 example, assume the radio paging unit was initially registered to the RegID of 8289 instead of 8288. This would represent: SID=8192, RID=96 and FID=1. When the paging unit controller 48 ceased to receive system messages and persisted in the No Service condition for a period of time, the paging unit controller would have changed the frequency of the paging receiver 30 to FID=0. When the system messages resumed with a RegID of 8304, the paging unit controller 48 would have determined that the RID portion of RegID (RID=97) differed from the RID portion of the CurrRegID (RID=96) and would have initiated re-registration, just as before. The changing of FID to 0, assured that if the radio paging unit moved to a region that utilized only one frequency, that the paging receiver 30 would be tuned to the only frequency assured to have a regional transmission system, by definition. Referring to the FIG. 13 example, assume the radio paging unit 18 was initially registered to the RegID of 8289 instead of 8288. As before, when the paging unit controller 48 ceased to receive system messages and persisted in the No Service condition for a period of time, the paging unit controller would have changed the frequency of the paging receiver 30 to FID=0. When system messages resumed with a RegID of 8288, the paging unit controller 48 would have determined that the RID portion of RegID (RID=96) matched that of the RID portion of CurrRegID (RID=96) and would have returned the paging receiver 30 to the FID portion of the CurrRegID (FID=1). Given equivalent geographic coverage for the overlapping regional transmission systems with RegIDs of 8288 and 8289, the paging unit controller 48 would begin to receive system messages from the 8289 regional transmission system.

The time value from the realtime clock 46 is used by the paging unit controller 48 to determine when system messages have ceased. It is also used to determine when No Service has persisted long enough to retune the paging receiver 30 to FID=0, when required. Timing is also used to record the periods of No Service determined by the paging unit controller 48. The realtime clock 46 is synchronized to the clock 15 of the routing controller maintaining the system time via the System Time (SysTime) field of system messages received.

The operation of the wide area paging system 10 described above is best illustrated by the flowcharts of FIGS. 20–29. For purposes of illustrating such operation, it will be assumed that there are two regional transmission systems 16: one with a RegID of 8288 and another with a RegID of 8304. Further, it will be assumed that there is a radio paging unit 18 which is currently registered for operation with the 8288 regional transmission system, where the radio paging unit initially resides. The regional transmission systems 16 are broadcasting periodic system messages from their associated transmitter sites.

The coded transmissions from the 8288 regional transmission system are being received by the radio paging unit 18 via its paging receiver 30 (FIG. 9). As each periodic system message is broadcast, the system message decoder 34 decodes the message and passes it to the paging unit controller 48. The system message in this example would contain RegID=8288, SysTime and AccessNumber. The paging unit controller 48 processes the received system message as shown in the flow chart of FIG. 20.

Figure 20:
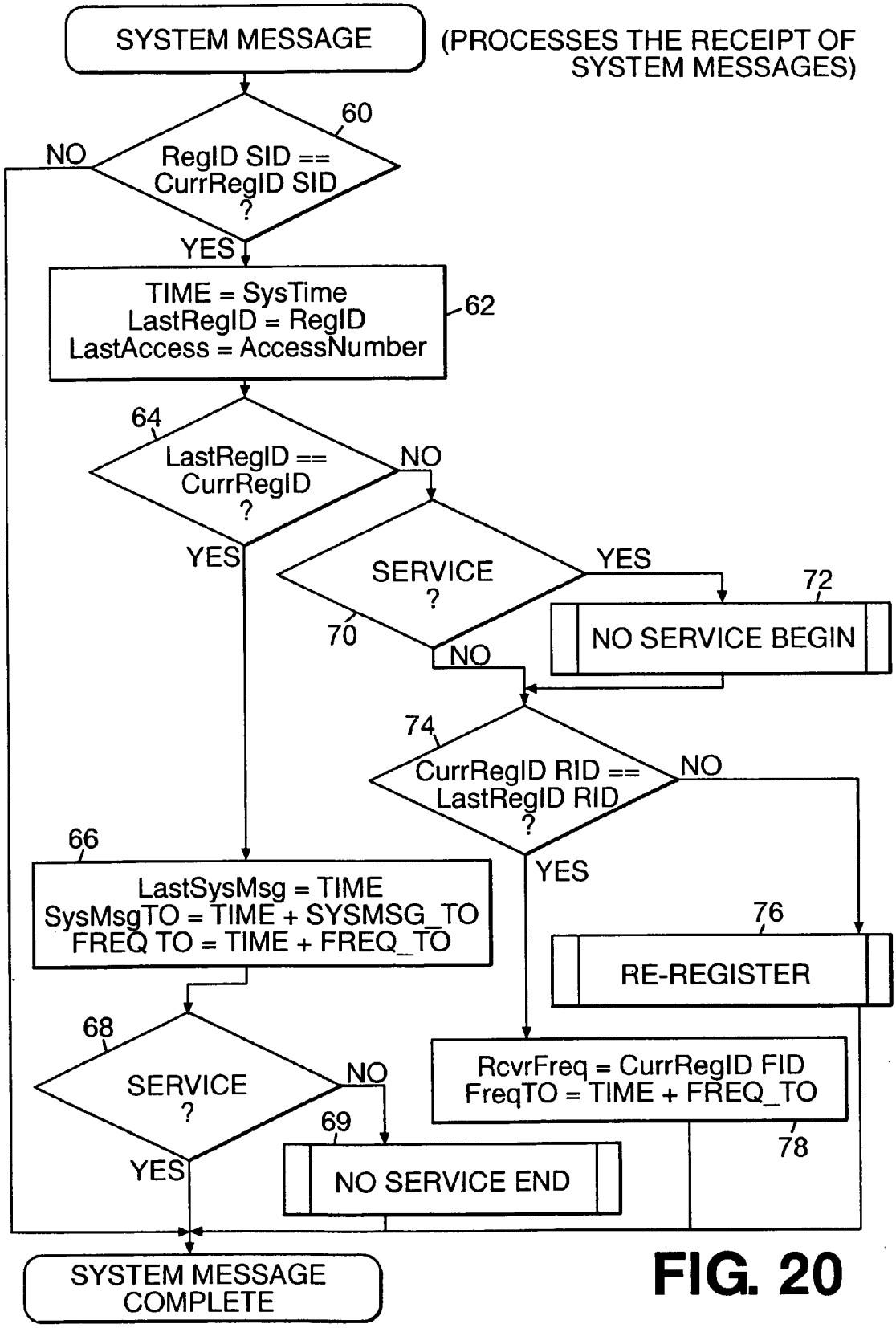
FIG. 20 is a flow chart for processing received system messages by the paging unit controller of FIG. 9.

Referring to FIG. 20, the operation of the paging unit in response to receiving a system message is shown. The paging unit controller 48 of the paging unit first checks if the SID of the RegID of the received system message matches the SID of its CurrRegID of registry stored in memory 44 (step 60). In the present example, the radio paging unit is receiving system messages from its current regional transmission system of registry, the SIDs match (SID=8192), so the paging unit controller uses the system message fields to set: Time of clock 46 (the variable time is used to keep system time in the radio paging unit) to SysTime; LastRegID to the RegID (RegID=8288); and LastAccess to AccessNumber (step 62). The paging unit controller then tests to see if LastRegID matches CurrRegID (step 64). In this example, the radio paging unit is receiving system messages from its current regional transmission system of registry, the RegIDs match, so the paging unit controller sets LastSysMsg to Time and sets SysMsgTO (the system message timeout timer) to Time plus SYSMSG_TO, and sets FreqTO (the frequency timeout timer) to Time plus FREQ_TO, where SYSMSG_TO and FREQ_TO are the timeout values in system time units (step 66). SYSMSG_TO is equal to the value of 2N (as described earlier in connection with FIG. 4), or other suitable value, while FREQ_TO may be set to the same or different value from SYSMSG_TO. Time, SysMsg_TO, FreQ_TO, and SYSMSG_TO, FREQ_TO represent variables stored in memory 44 of the radio paging unit. The paging unit controller then tests service to determine whether the unit is in the Service or No Service state (step 68). The state of Service of the unit is stored in a Service Flag in memory 44 which is set to YES (service) or NO (no service). The paging unit controller 48 determine the state of the radio paging unit by checking this flag, which is referred to herein as "Service". Since in this example the unit has been receiving regular periodic system messages from its current regional transmission system of registry, it would be in the Service state (i.e., Service Flag is set to YES) and the routine ends. The system message routine is executed after each system message is received by a paging unit 18.

As the radio paging unit 18 moves from its current region to a new region, the receipt of system messages will be as depicted in FIG. 12. The radio paging unit will continue to receive system messages from RegID 8288 until it moves out of the prescribed coverage area for the regional transmission system having that RegID, when the receipt of system messages will cease. This will be detected by the paging unit controller 48 in its Realtime Clock routine shown in FIG. 21.

Figure 21:
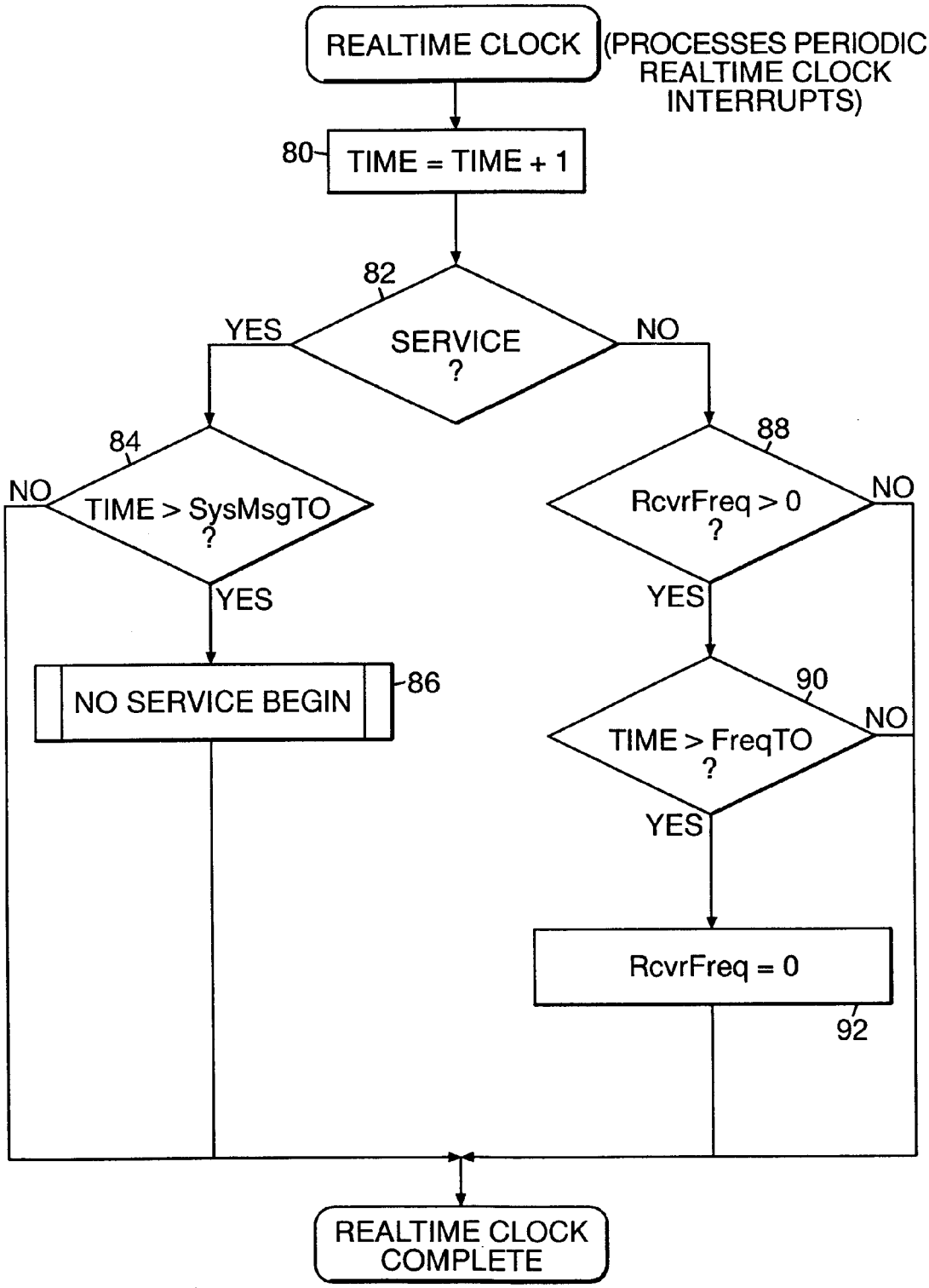
FIG. 21 is a flow chart for the Realtime Clock routine performed by the paging unit controller of FIG. 9.

Each time the realtime clock 46 ticks (advances) in units of system time, the clock provides a software interrupt to the paging unit controller 48, and the Realtime Clock routine of FIG. 21 is executed. The paging unit controller 48 first increments Time by one (step 80). It then checks to see if the radio paging unit 18 is in the Service or No Service state (step 82). Until now, in this example, the radio paging unit has been receiving regular periodic system messages from its regional transmission system 18 of registry, so it is in the Service state. Accordingly, the paging unit controller 48 proceeds to check whether Time has exceed the SysMsgTO time (step 84). If not, the routine ends. If Time has advanced the SYSMSG_TO time from the time from the last in region system message was received at step 84, the paging unit controller branches to call the NoService Begin routine of FIG. 22 (step 86). The No Service Routine may also be called in the system message routine at step 72 when the current registered transmission system stored at CurrRegID does not match at step 64 the received RegID of the last system message, LastRegID, and the Service state is YES at step 70.

Figure 22:
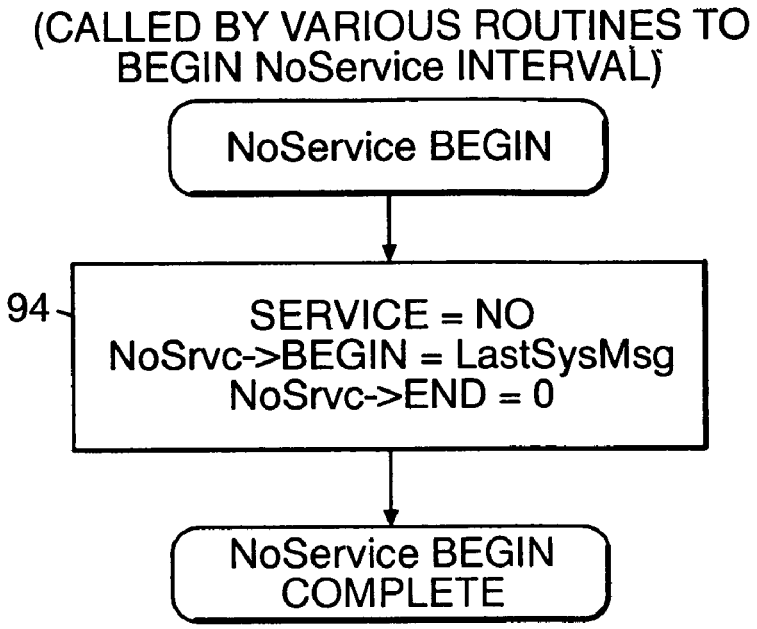
FIG. 22 is a flow chart for the NoService Begin routine performed by the paging unit controller of FIG. 9.
Figure 23:
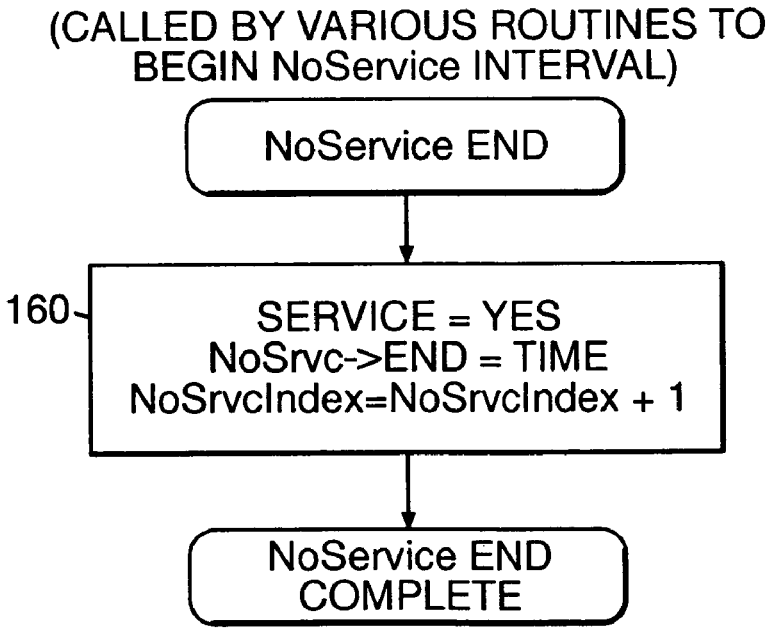
FIG. 23 is a flow chart for the No Service End Routine performed by the paging unit controller of FIG. 9.

FIG. 22 shows the flow chart of the NoService Begin routine. Upon entry to this routine, the Service state is set to NO (step 94). Using a data structure in memory 42 shown in FIG. 14, the paging unit controller stores in memory 44 of No Service periods of time (step 94). This data structure, NoSrvc, includes an index (NoSrvcIndex) and an array of elements, each element having two members (Begin and End). The index is used to point to the first available element in the NoSrvc array of elements. Each element is used to store a bounded period of time of No Service, bounded by a beginning time (Begin) and an ending time (End). After setting the Service state to NO, the NoService Begin routine then sets the Begin member of the currently indexed array element (initially zero) to the LastSysMsg time stored in memory 44, which is the time of the last successfully received in region system message. The paging unit controller 48 then sets the End member to zero (0). By convention, time values of zero are presumed to be equal to the current Time value for all moments in time. Accordingly, the NoSrvc element entry means that there is a bounded period of No Service extending from LastSysMsg time till now. NoService Begin then returns to the caller, the Realtime Clock routine (step 86 of FIG. 21), which subsequently ends.

Referring back to FIG. 21, the Realtime Clock routine is executed again on the next tick of the realtime clock 46, incrementing the Time variable (step 80). Now in this example, however, the Service state is NO causing the paging unit controller 48 to branch to the check of the paging receiver's frequency (RcvrFreq) at step 88. RcvrFreq is a variable stored in memory 44 and is equal to the FID of the CurrRegID. As the CurrRegID is 8288 which has an FID of 0, RcvrFreq will be zero (0), the universal wide area frequency for the radio paging system, so no other action is required, and the Realtime Clock routine ends. Upon each subsequent tick of the realtime clock, the Realtime Clock routine will repeat the above until the unit changes the Service state back to YES. The situation when the RcvrFreq is greater than zero (at step 88) will be described later.

In this example, when the radio paging unit 18 enters a new regional transmission system 16, it will begin receiving system messages with a RegID of 8304, as shown in FIG. 12. Referring again to FIG. 20, upon receiving this system message, the SID of RegID from the system message is compared to the SID of the CurrRegID, both of which are 8192 (step 60). Accordingly, the paging unit controller 48 uses the received system message to set: Time to SysTime, LastRegID to RegID and LastAccess to AccessNumber (step 62). The paging unit controller 48 then checks if LastRegID matches CurrRegID (step 64). As the unit 18 is in a new region in this example, the RegID values do not match, so the paging unit controller 48 checks the Service state (step 70), finding the unit in the No Service state. The paging unit controller 48 then checks to see if the RID of LastRegID the RID of CurrRegID (step 74). As the radio paging unit is in a new region in this example, the RID values do not match. Accordingly, the paging unit controller 48 determines that the radio paging unit 18 needs to re-register with the new region, so the Re-Register routine of FIG. 25 is called (step 76).

Figure 25:
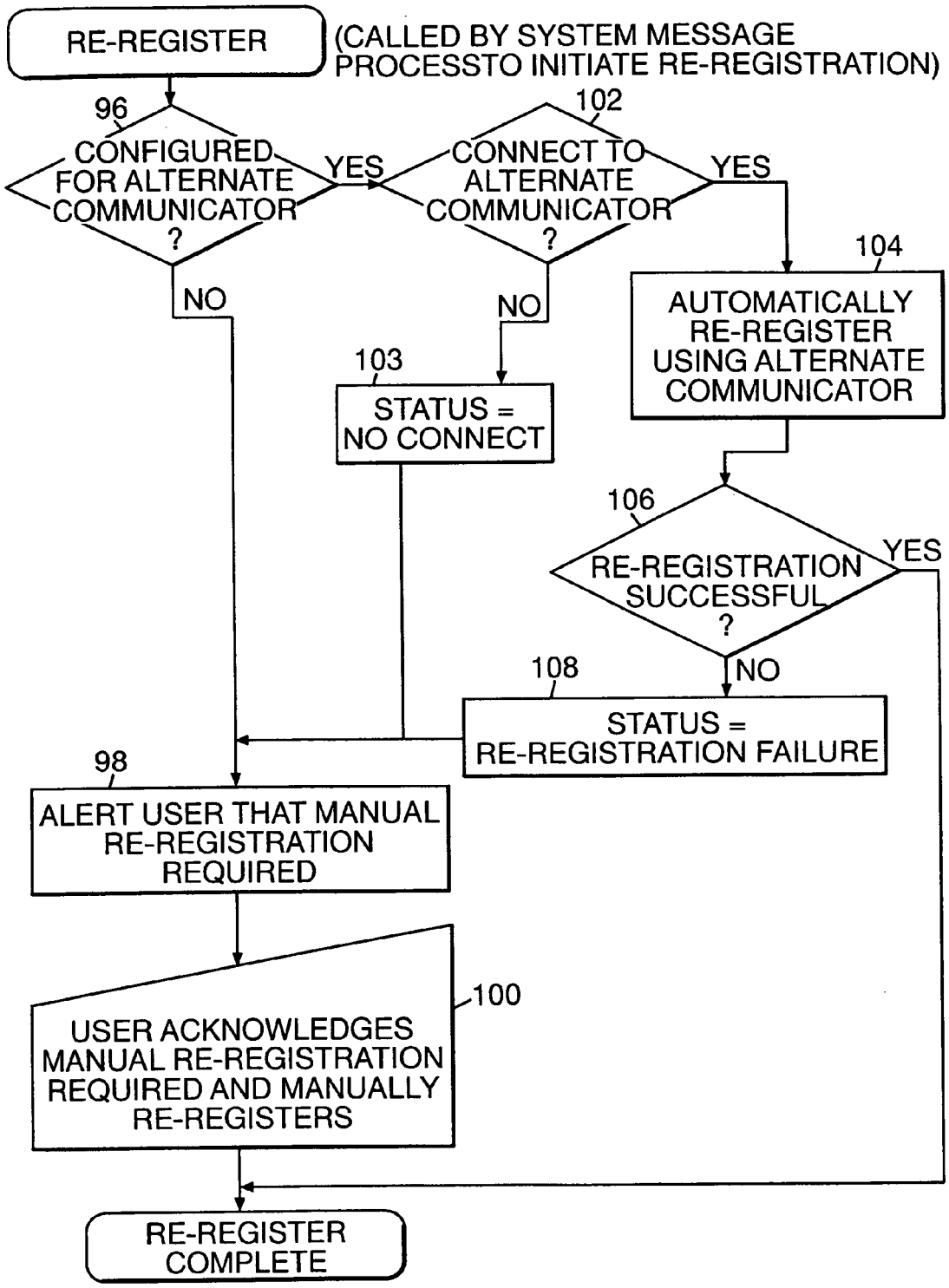
FIG. 25 is a flow chart for the re-registration process performed by the paging unit controller of FIG. 9.

Referring to FIG. 25, the paging unit controller 48 first checks at step 96 if the radio paging unit is configured for use of an alternate communications device 50 (FIG. 10). If it is not, then the user is alerted to the need for manual re-registration (step 98). The paging unit controller 48 waits for the user to acknowledge this notification before exiting the Re-Register routine (step 100). If the radio paging unit was configured for use of an alternate communications device 50, then the paging unit controller 48 at step 102 attempts to connect to the alternate communications device 50 using the external interface 42 (FIG. 4). If the paging unit controller cannot connect to the alternate communications device (step 103), then the paging unit controller proceeds to alert the user to the need for manual registration (step 98) and waits for the user's acknowledgment of this notification before exiting (step 100). If the paging unit controller 48 is successful in connecting to the alternate communications device 50, then the paging unit controller sends the re-registration information (the control input information of FIG. 15) for communication by the alternate communications device to one of the control input unit 20 (FIG. 2) of the radio paging system (step 104). If the alternate communications device 50 indicates that the re-registration communication was successful (step 106), then the paging unit controller exits the Re-Register routine, else the paging unit controller 48 proceeds to alert the user to the need for manual re-registration and waits for the user's acknowledgment of this notification before exiting. A Status Flag stored in memory 44 is set to upon failure to connect or register using the alternate communications device (such as shown at step 103 or 108). If manual re-registration is required, then the user must take action to affect re-registration with message routing controller 12 (FIG. 1). Through a sequence of depressing one or more pushbuttons 38 (FIG. 9) the user acknowledges the need for manual registration (step 100), and the paging unit controller 48 enters the Manual Re-Register routine shown in FIG. 27 to enable the user to manually re-register.

Figure 27:
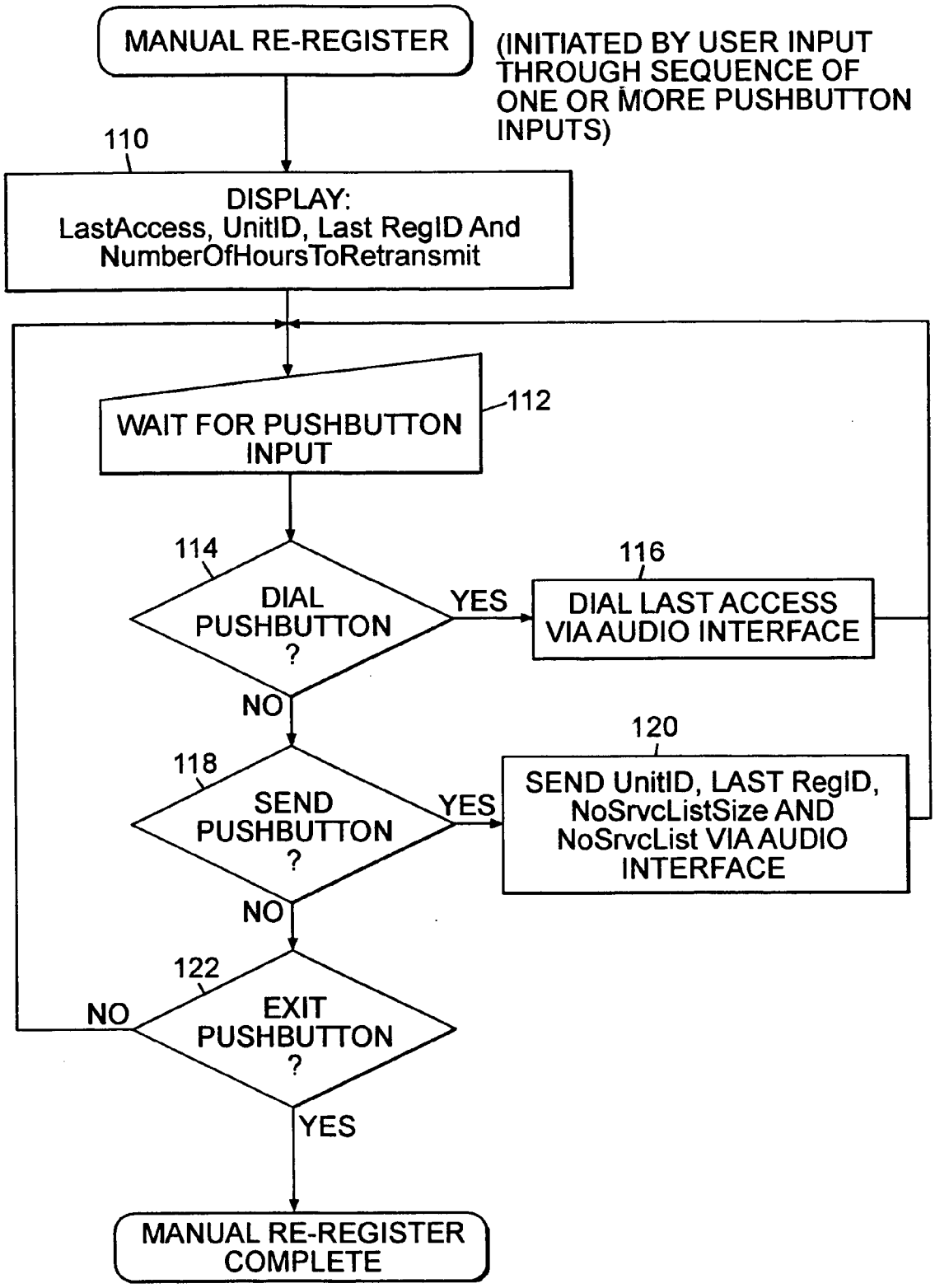
FIG. 27 is a flow chart for manual re-registration processing performed by the paging unit controller of FIG. 9 in conjunction with the user of the paging unit.

In FIG. 27, the paging unit controller 48 uses the display 36 (FIG. 4) to display LastAccess, UnitID, LastRegID and the NumberOfHoursToRetransmit (step 110). The paging unit controller 48 then waits for pushbutton 38 input (step 112). The user may manually affect re-registration by using the keypad on a telephone instrument, which established a connection at the LastAccess phone number to one of control input units 20 (FIG. 1), to manually enter the information from the display 36. For example, the control input unit may voice prompt the user to enter UnitID, LastRegID and NumberOfHoursToRetransmit. Alternatively, the user may semiautomatically affect re-registration at steps 112–122 in which pushbuttons 38 designated as Dial, Send and Exit are provided on the radio paging unit. By using the Dial and Send pushbuttons in conjunction with a telephone instrument, a user can semiautomatically enter the control input information depicted in FIG. 15. If the Dial pushbutton is operated (step 114), then the paging unit controller uses the audio interface 40 to send LastAccess as DTMF dialing information (step 116) and returns to the Pushbutton input point. This establishes a connection to the control unit input 20 (FIG. 1) associated with LastAccess. If the Send pushbutton is operated (step 118), then the paging unit controller uses the audio interface 40 to send the control input information shown in FIG. 15 as DTMF or other audio signaling method (step 120). If the Exit pushbutton input is operated (step 122), then the paging unit controller exits the Manual Re-Register routine.

Figure 29A:
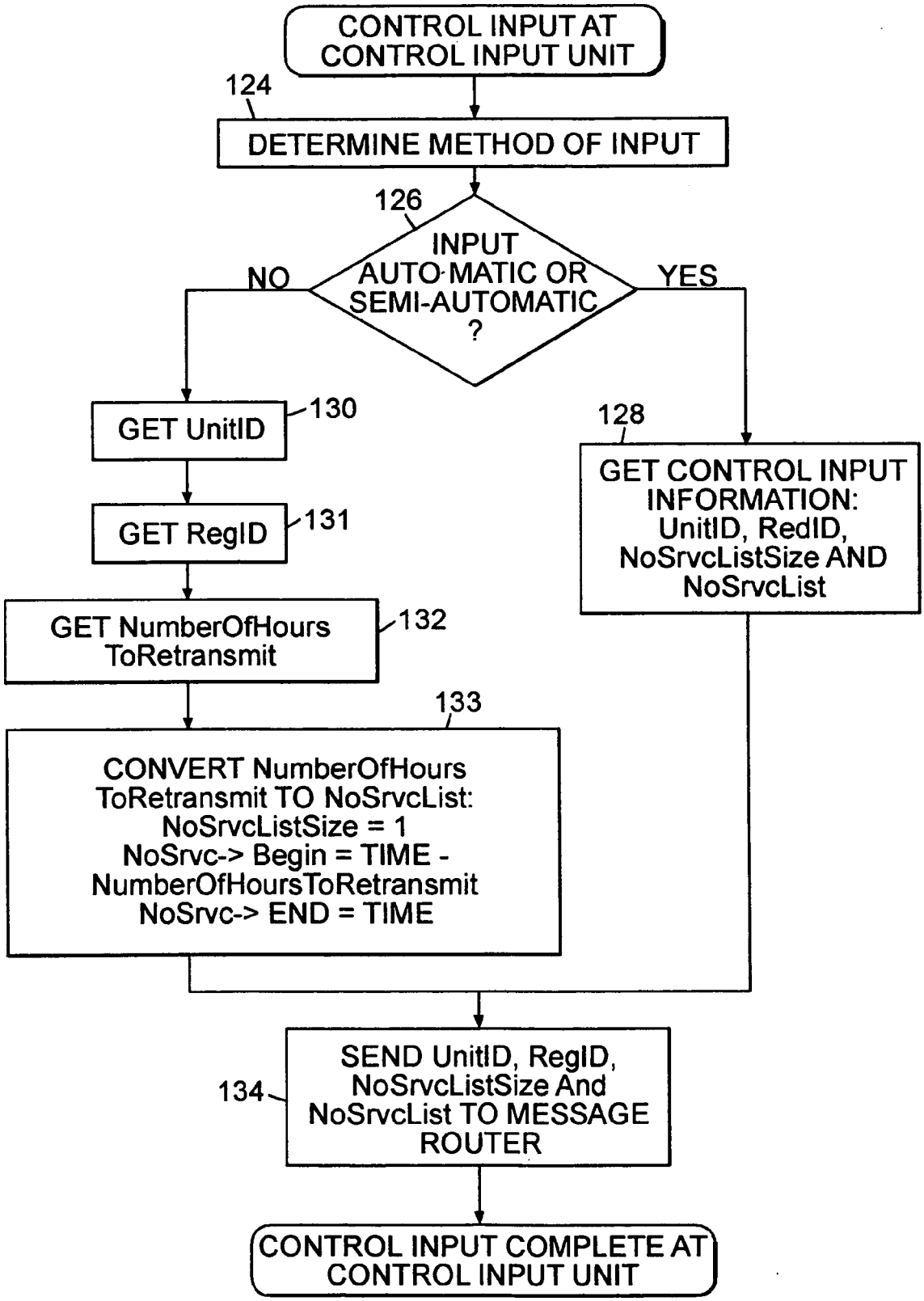
FIG. 29*a* is a flow chart for the processing performed by the control input unit of the radio paging system of FIG. 1 in receiving control input information from a paging unit.

Regardless of automatic, semiautomatic or manual re-registration, the requisite re-registration information is submitted to one of the control input unit 20 (FIG. 1). The control input units 20 accept the information and pass the information onto the message routing controller 12 (FIG. 1) in accordance with the flow charts shown in FIGS. 29*a* and 29*b*. In FIG. 29*a*, when the control input unit 20 is accessed, it first determines whether the input is manual, or automatic or semiautomatic (step 124). If the input is automatic or semiautomatic at step 126, the unit gets the control input information defined in FIG. 15 (step 128) and passes this information to the message routing controller 12 for processing (step 134). If the input is manual, the unit gets the control input information defined in FIG. 16 (steps 130, 131 and 132). It then converts the NumberOfHoursToRetransmit into a NoSrvcList with a NoSrvcListSize of 1 (single record) by setting the first element Begin to the current time minus the value of NumberOfHoursToRetransmit, and the second element End is set to zero to indicate current time (step 133).

Figure 29B:
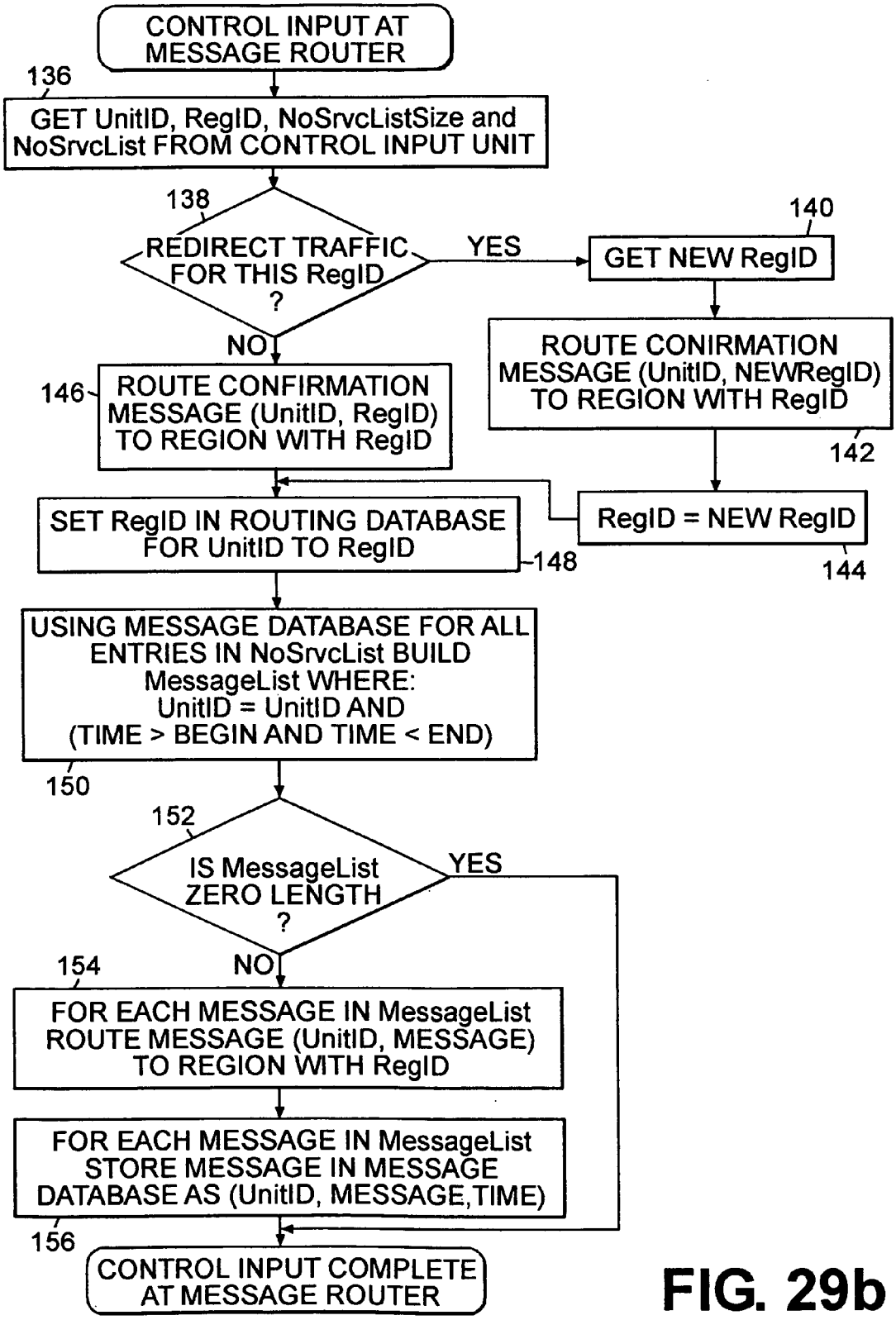
FIG. 29*b* is a flow chart for the processing performed by the message routing controller of the radio paging system of FIG. 1 in response to the control input unit receiving control input information.

The information received from the control input unit is passed to the routing controller for processing as shown in FIG. 29*b* (step 134).

In FIG. 29*b*, the routing controller 12 gets the control input information (UnitID, RegID, NoSrvcListSize and NoSrvcList) from the control input unit 20 (step 136). Based on the RID for the new RegID that the radio paging unit is attempting to register with, the routing controller 12 checks if there is an alternate regional transmission systems that, for traffic loading or other purposes, the radio paging system would like to redirect the radio paging unit to (step 138). Traffic loading refers to the balancing of the page messages capacity of one or more regional transmission systems having approximately the same region coverage in order to avoid overloading of a regional transmission system which would cause significant delays in message delivery to a region. If there is an alternate regional transmission system, then the routing controller 12 gets a new, equivalent (in terms of approximate geographic region coverage) RegID (step 140), and sends the confirmation message (FIG. 11) with the new RegID to the radio paging unit at the RegID originally supplied by the radio paging unit (step 142) and then sets RegID to be the New RegID (step 144). For example, this may be a RegID with the same SID and RID, but different FID. If there is no alternate regional transmission system 16 to redirect traffic, the routing controller sends a confirmation message to the radio paging unit with the RegID received from the control input unit (step 146). In any event, the routing controller 12 proceeds to change the RegID field for the UnitID in the Routing Database to the current RegID value at step 148 (whether the value originally supplied by the radio paging unit or the value replaced by the New RegID). The Routing Database, shown in FIG. 17, has rows (records) in which each row is provided for each UnitID of the radio paging units, and modifies (stores) as a row element the RegID of the regional transmission system 16 the radio paging unit 18 is registered to. Using the Message Database, shown for example in FIG. 18, and all entries of the NoSrvcList, shown for example in FIG. 15, the routing controller 12 builds a single MessageList having the UnitID and message(s) from those messages stored in the records of the Message database which match the UnitID and have a Time field (time message sent) between NoSrvcList Begin and End times (step 150). The routing controller 12 then checks if the MessageList is zero length (step 152). If it is, processing is complete, else the routing controller 12 sends the messages in the MessageList to the paging unit (step 154) and stores copies of the messages with times sent in the Message Database (step 156). Each of the messages sent, if any, are routed to the current RegID for the radio paging unit, as stored in the Routing Database.

The confirmation message produced by the routing controller 12 at step 142 or 146 is routed by the routing controller to the regional transmission system 18 specified by the RegID supplied by the radio paging unit 18. The confirmation message is received at the regional transmission system 16 by the paging encoder 24 (FIG. 2) which encodes the message for subsequent broadcast by the one or more transmitter sites 28 associated with the regional transmission system. The encoded radio paging message is fed to the regional system controller 26 which codes and formats the information appropriately for conveyance over the one or more link systems to, and control over, the one or more transmitter sites 28. The transmitter controller 28*a* decodes data from the regional system controller to effect control over the transmitter 28*b* and to recover the coded radio paging messages suitably for modulation of the transmitter 28*b* to deliver coded radio paging transmissions to radio paging units.

The paging receiver 30 (FIG. 9) of the radio paging unit 18 receives and demodulates the coded transmission. The demodulated output is fed to the message decoders 32–34 (FIG. 9). The confirmation message is a unit message addressed to a specific radio paging unit via their unique UnitID. The intended recipient of the confirmation message will be a radio paging unit with its unit message decoder 32 configured to respond to the specific UnitID used with the message. That unit message decoder will decode the message as a confirmation message, and send the message to the paging unit controller for processing. The paging unit can differentiate the confirmation message from other unit messages received. For example, when the paging protocol of the system supports the capability to send control messages and information messages, the message routing controller may send the confirmation message as one of the control message to the paging unit, while the information messages may be other unit messages. Alternatively, the differentiation of confirmation message from other messages may be achieved by having for each paging unit two different UnitID, one for sending control messages and the other from sending information messages. The message routing controller then uses the control message UnitID to route the confirmation messages to the paging unit. The paging unit controller 48 will process the confirmation message as shown in the flow chart of FIG. 26.

Figure 26:
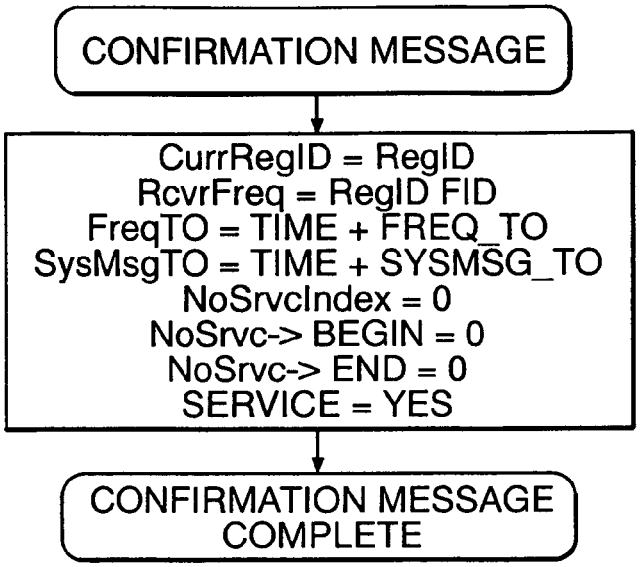
FIG. 26 is a flow chart for the processing of received confirmation messages by the paging unit controller of FIG. 9.

In FIG. 26, the paging unit controller 48 (FIG. 9) at step 158 sets its CurrRegID in memory 44 to RegID provided in the confirmation message, which may be the LastRegID that it supplied as a part of the re-registration process or it may be the RegID that the radio paging system is redirecting the radio paging unit to. The paging unit controller 48 then sets the paging receiver 30 frequency, RcvrFreq, to the FID value specified in the RegID and restarts the FreqTO and SysMsgTO timeout timers. Finally, the paging unit controller 48 changes the Service state to YES and clears the NoSrvc array by setting the NoSrvcIndex to zero and setting the first element members, Begin and End, to zero. This completes the re-registration process pursuant to a radio paging unit moving from one region to another region.

In another example, when a radio paging unit 18 moves outside the coverage area of its current region of registry and then back into the same region, the receipt of system messages will be as depicted in FIG. 13. The radio paging unit will continue to receive system messages from RegID 8288 until it moves out of the prescribed coverage area, when the receipt of system messages will cease. This will be detected by the paging unit controller 48 in its Realtime Clock routine of FIG. 21. Upon entry to the routine, the paging unit controller 48 increments Time by one (step 80), the timekeeping variable stored in memory 44. It then checks to see if the unit 18 is in the Service or No Service state (step 82). Until now, in this example, the radio paging unit 18 has been receiving regular periodic system messages from its regional transmission system 16 of registry, so it is in the Service state. Accordingly, the paging controller 48 proceeds to check whether Time has exceed the SysMsgTO time (step 84). If not, the routine ends. When Time has advanced SYSMSG_TO time from the time that the last in region system message was received, the paging unit controller 48 at step 86 will branch to call the NoService Begin routine of FIG. 22. Upon entry to this routine, the Service state is set to NO (step 94). The paging unit controller 48 keeps track of (stores) No Service periods of time in NoSrvc, as described earlier. NoService Begin then returns to the caller, the Realtime Clock routine (step 86 of FIG. 21), and the Realtime Clock routine ends. On the next tick of the realtime clock, the realtime clock routine is executed again, incrementing the Time variable (step 80). This time, however, the Service state is No Service causing the paging unit controller 48 at step 82 to branch to the step 88 check of the paging receiver's frequency (RcvrFreq). In this example, as the CurrRegID is 8288 which has an FID of 0, the paging receiver's frequency will be zero (0), the universal wide area frequency for the radio paging system, so no other action is required. Upon each subsequent tick of the realtime clock, the Realtime Clock routine will repeat the above until the unit changes the Service state back to YES.

When the radio paging unit 18 reenters its current region of registry in this example, it will begin receiving system messages with a RegID of 8288. In FIG. 20, the SID of RegID of the received system message will be compared to the SID of the CurrRegID, both of which are 8192 (step 60). Accordingly, the paging unit controller 48 will set: Time to SysTime, LastRegID to RegID and LastAccess to AccessNumber (step 62). The paging unit controller then checks to see if RegID matches CurrRegID (step 64). As the radio paging unit 18 has reentered the same region, the RegID values will match, so the paging unit controller 48 will set LastSysMsg to Time and restart SysMsgTO, the system message timeout timer, by setting SysMsgTO to Time plus SYSMSG_TO, and restart FreqTO, the frequency timeout timer, by setting FreqTO to Time plus FREQ_TO (step 66). The paging unit controller 48 will then check its Service state (step 68). As this is the first system message since the radio paging unit 18 left the coverage region, the Service state will be NO, so the paging unit controller 46 will call the NoService End routine (step 69). The NoService End routine, shown in FIG. 23, sets the Service state to YES, sets the current NoSrvc End element member to Time, and increments the NoSrvcIndex to point to the next element in the NoSrvc array (step 160). The radio paging unit is now back in service in its current, and original, region of registry. No re-registration was required as no system messages were received with the same SID but a different RID.

A radio paging unit 18 may also be registered with a RegID having a non-zero FID, and thus operates on an alternate frequency than the system wide frequency. The following description describes the use of multiple FID values and is the same as described above, except as follows. For purposes of the following example, assume that there are three regional transmission systems 16: one with a RegID of 8288, one with a RegID of 8289 and, lastly, one with a RegID of 8304. Further, it will be assumed that there is a radio paging unit which is currently registered for operation with the 8289 regional transmission system, where the radio paging unit initially resides. The regional transmission systems 16 are broadcasting periodic system messages from their associated transmitter sites.

In this example, the radio paging unit 18 is moving from a RegID operating on an alternate frequency to a new region. The 8289 regional transmission system broadcasts system messages which are received and decoded by radio paging unit 16 in the same manner as above. The 8289 RegID has an FID of 1, meaning that the paging receiver 30 frequency is 1. When the radio paging unit moves from the 8289 region to the 8304 region, the 8289 system messages will cease and, at some point and some time later, the 8304 system messages will begin. Referring to FIG. 21, the radio paging unit will detect the cessation of system messages in the Realtime Clock routine and change its Service state to NO through the SysMsgTO (steps 84, 86, and 94), just as described earlier. The next time the Realtime Clock routine is entered, however, the test of "RcvrFreq>0" (step 88) will yield YES, as the CurrRegID of 8289 produces an FID of 1. This will cause the paging unit controller to test for FreqTO timeout (step 90). When FreqTO times out (or expires), the RcvrFreq is set to 0 (step 92), even though the FID of the CurrRegID is 1. This changes the paging receiver 30 to the universal wide area radio paging frequency. If the overlapping coverage areas of RegIDs 8288 and 8289 are equivalent, then the radio paging unit will not receive any system messages until it enters the coverage region of RegID 8304. When this occurs, referring to FIG. 20, the paging unit controller 48 will determine that the RegID does not match the CurrRegID at step 64 and that there is No Service at step 70. Further, it will determine that the RIDs of RegID and CurrRegID do not match at step 74. Accordingly, it will re-register as described earlier in connection with FIGS. 25–27 (step 76).

In another example, the radio paging unit 18 is moving out of the coverage area of a RegID operating on an alternate frequency and moving back into the same region. The 8289 regional transmission system 16 broadcasts system messages which are received and decoded by radio paging unit 18 in the same manner as above. The 8289 RegID has an FID of 1 which means that the paging receiver 30 frequency is 1. As depicted in FIG. 12, when the radio paging unit moves out of the 8289 region and back into the 8289 region, the 8289 system messages will cease at some point and, at some time later point, the 8289 system messages will begin again. Referring to FIG. 21, the radio paging unit 18 will detect the cessation of system messages in the Realtime Clock routine and change its Service state to NO through the SysMsgTO timeout (steps 84, 86, and 94), as described earlier. The next time the Realtime Clock routine is entered, Service state is NO (step 82) and the test of RcvrFreq>0 will yield YES (step 88), as the CurrRegID of 8289 produces an FID of 1. This will cause the paging unit controller to test for FreqTO timeout (step 90). When FreqTO times out, the RcvrFreq will be set to 0, even though the FID of the CurrRegID is 1. This will force the paging receiver to the universal wide area radio paging frequency. If the overlapping coverage areas of RegIDs 8288 and 8289 are equivalent, then the radio paging unit will not receive any system messages until it enters the coverage region of RegID 8288. When this occurs, referring to FIG. 20, the paging unit controller 48 will determine that the RegID does not match the CurrRegID (step 64) and that there is No Service (step 70). It will determine, however, that the RIDs of RegID and CurrRegID do match (step 74). Given equivalent overlapping coverage between 8288 and 8289, the receiver should be able to receive system messages from 8289. Accordingly, it will set its RcvrFreq to the FID of its CurrRegID and restart the FreqTO timeout timer (step 78). Before this timer times out (or expires), the radio paging unit should begin receiving system messages from 8289.

The foregoing detailed descriptions pertained to the regional transmission systems 16 and radio paging unit 18 registration with the transmission system. The following detailed description will explain how page messages for users are delivered to radio paging units via the same regional transmission systems.

Messages for deliver to radio paging units 18 are submitted to message input units 14, as shown in FIG. 1. Message originators can connect to message input units 14 including by one or more of the following interfaces: the Public Switched Telephone Network (PSTN), the worldwide Internet, private networks, public networks or other like means. Regardless of the means used to connect to the message input units 14, the interfaces must be able to provide two essential components of information: (1) unique message input identification, which defines the radio paging unit or units 18 to receive the message, and (2) the message data itself. Message input processing is in accordance with the flow charts of FIGS. 28*a* and 28*b*.

Figure 28A:
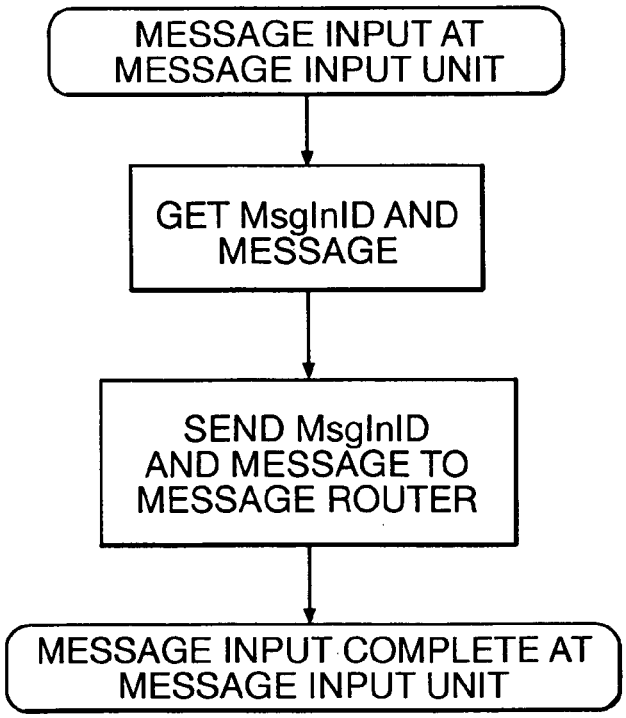
FIG. 28*a* is a flow chart for the processing by the message input unit of the radio paging system of FIG. 1 in response to receiving input of a page message.
Figure 28B:
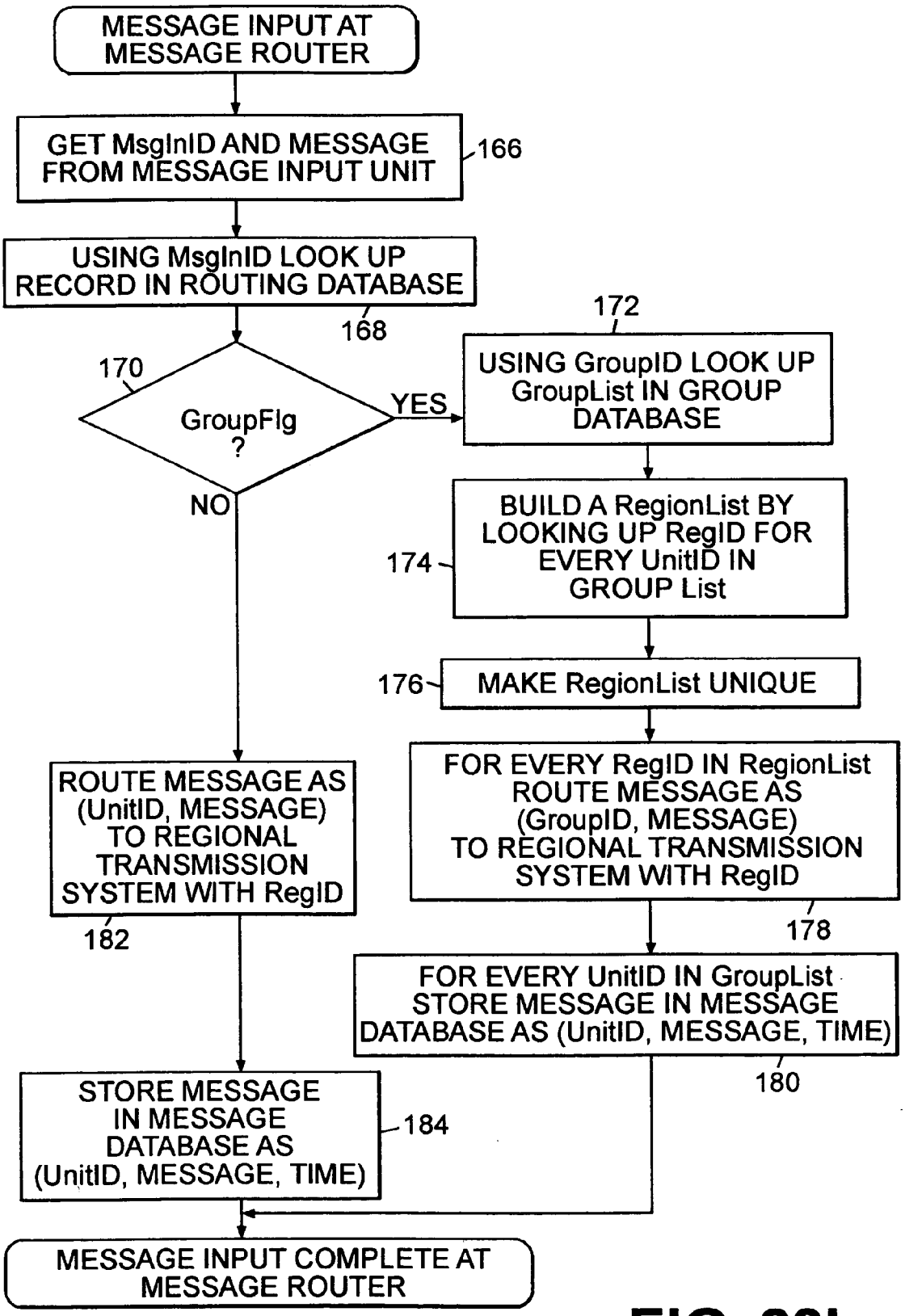
FIG. 28*b* is a flow chart for the processing performed by the message routing controller of the wide area paging system of FIG. 1 in response to the message input unit receiving a page message.

In FIG. 28*a*, the message input unit 14 received a page message having Message Input Identification (MsgInID) and the message data (message) from the message originator via an appropriate interface to the input unit (step 162). The message input unit 14 then sends this information to the routing controller 12 (step 164). Next, as shown in FIG. 28*b*, the routing controller accepts (MsgInID, Message) requests from message input units 14 (step 166). Using the MsgInID and the Routing Database, shown for example in FIG. 17, the routing controller looks up the record which has the matching unique MsgInID in the MsgInID field of the record (step 168). At this point, the routing controller 12 checks the GroupFlg (Group Flag) to determine if the record defines a UnitID or a GroupID (step 170). A UnitID characterizes the message as being addressed to only one radio paging unit. A GroupID characterizes the message as being addressed to a group plurality) of radio paging units.

If the GroupFlg is YES, then the page message is for a group of radio paging units. Group Messages are processed by using the GroupID from the record to look up a GroupList in the Group Database (step 172), shown for example in FIG. 19. The GroupList is a variable length list of one or more UnitIDs. The routing controller uses the GroupList to build a RegionList in its memory by looking up the RegID in the Routing Database for each UnitID in the GroupList and adding it to the RegionList (step 174). The routing controller then makes the RegionList unique by eliminating all duplicate RegIDs in the list (step 176). For every RegID remaining in the list, the routing controller routes a message as (GroupID, Message) to the regional transmission system represented by the RegID (step 178). For every UnitID in the GroupList, the routing controller stores a message in the Message Database, depicted in FIG. 18, as (UnitID, Message, Time) where Time is the time of message transmission to the regional transmission system provided by time source 15 (step 180).

If the GroupFlg is NO at step 170, then the message is for a single radio paging unit. Unit messages are processed by the routing controller routing a message as (UnitID, Message) to the RegID specified in Routing Database record (step 182). The routing controller then stores a copy of the message in the Message Database as (UnitID, Message, Time) where Time is the time of message transmission to the regional transmission system provided by time source 15 (step 184).

Messages routed to regional transmission systems, whether unit messages or group messages, are accepted by the paging encoder 24 (FIG. 3) of the transmission systems 16, where the messages are encoded for ultimate transmission by the one or more transmitter sites of the region to radio paging units. The radio paging units 18 receive the coded transmissions via the paging receiver 30 (FIG. 9). The paging receiver 30 demodulates the coded transmissions and the output of the paging receiver is passed to the message decoders 32–34. Unit messages are decoded by the unit message decoder, which is configured to respond to the unique UnitID. As only one radio paging unit in the radio paging system is configured with any given UnitID, only one radio paging unit will decode the message, providing the associated message to the radio paging unit controller 48 for normal paging message processing. Group messages are decoded by the group message decoder, which is configured to respond to a particular, but not necessarily unique, GroupID. As many radio paging units can be configured with a given GroupID, many radio paging units may simultaneously decode the message, feeding the associated message to their respective radio paging unit controller for normal paging message processing. The user is alerted to the receipt of page messages as in typical pagers.

Figures 19, 24:
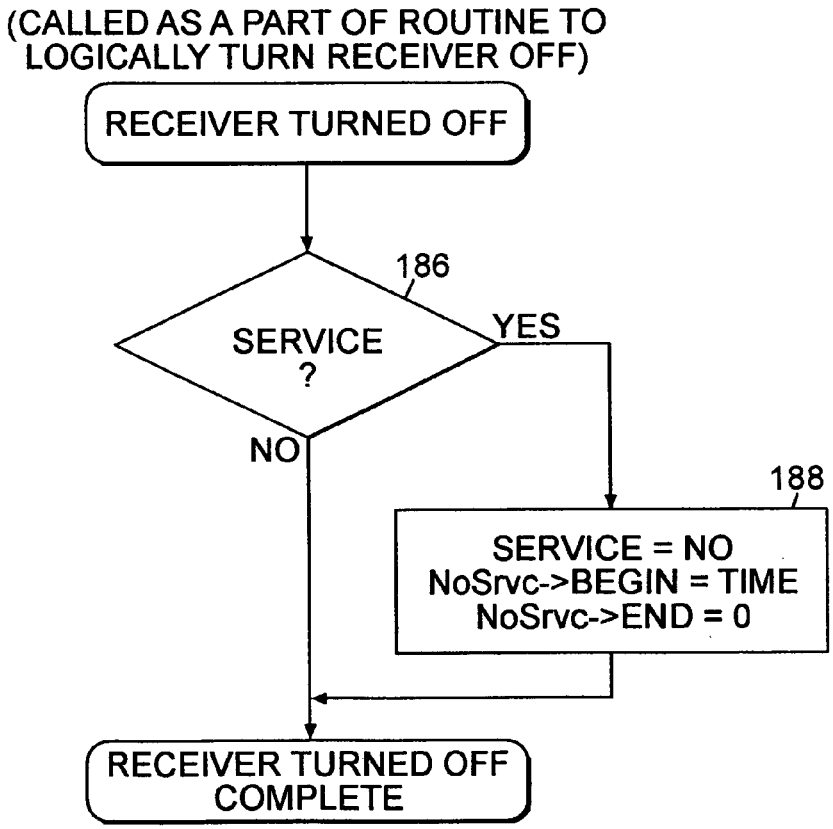
FIG. 19 is the data structure for the Group Database in memory of the message routing controller in the radio paging system of FIG. 1 for identifying the particular paging units which can be associated with a group identifier (GroupID) of the Routing Database of FIG. 17.
FIG. 24 is a flow chart for the Receiver Turned Off routine performed by the paging unit controller of FIG. 9.

Referring to FIG. 24, the Receiver Turned Off routine is shown which is executed by the paging unit controller when a user logically turns the paging unit receiver off, such that page messages cannot be received. The paging unit controller first checks if the paging unit is in a Service state (step 186). If the Service state equals yes, the paging unit controller sets Service to NO, initiates a new entry in the NoSrvc array by setting a first element member Begin to Time (the time of the clock 46) and the second element member End to zero (step 188). A NoSrvc array entry is thus produced having the bounded period of time that the paging unit's receiver was turned off until the unit is again receiving system messages. When the receiver of the paging unit is logically turned back on, the paging unit controller begin looking for the system messages. If the RegID of the next received system message differs from the CurrRegID of the paging unit, then the paging unit has moved to a new region while it was off and re-registration will initiate, as if the receiver paging unit had moved into a new region while it was on. If the RegID of the next received system message is the same as the CurrRegID, then the paging unit did not change regions while it was off and no re-registration is required, as if the receiver (i.e., paging unit) moved out of a region and then back in into the same region. Optionally, if the paging unit did not change regions while it was off, a user may be notified by the paging unit to initiate re-registration to obtain messages sent to the paging unit while the receiver was off, or the paging unit controller automatically initiates re-registration if a record in the NoSrvc array exceeded a predefined limit (i.e., time limit>End-Begin), such as an hour. Similarly, independent of the paging unit being turned off and back on, if a paging unit has not changed regions, a user may be notified by the paging unit to initiate re-registration to obtain messages sent to the paging unit while the receiver was out of coverage, or the paging unit controller automatically initiates re-registration if a record in NoSrvc array exceeds a predefined limit (i.e., time limit>End-Begin), such as an hour. If user initiate re-registration is provided, the depressing of another one of the pushbuttons 38 on the paging unit would direct the paging unit controller to execute the Re-register routine (FIG. 25). From the foregoing description, it will be apparent that there has been provided an improved wide area paging system. Variations and modifications in the herein described system and method in accordance with the invention will undoubted suggest themselves to those skilled in the art. For example, the present invention could be applied to radio paging systems which support multifrequency operation with scanning receivers, in which the term "frequency" in the above description could be substituted for "sets of frequencies" for application to multifrequency radio paging systems which use scanning radio paging receivers. Further, the data structures shown in the figures and described herein are exemplary and other types of data structures may be used to store their information. Accordingly, the foregoing description should be taken as illustrative and not in a limiting sense.

What is claimed is:

1. A paging system for providing page messages to radio receiving paging units over a wide area through a plurality of page message transmission systems in which each of said transmission systems is associated with a predefined coverage area in said wide area, said system comprising:

a system controller having memory storing a routing database registering each of said paging units with one of said transmission systems, in which said controller routes page messages received by said system to each of said paging units through one of said transmission systems to which the paging unit is registered in accordance with said routing database, wherein the transmission system to which each of the paging units is registered represents the transmission system registered to the paging unit;

a plurality of transmission systems, each of said transmission systems being operative for sending page messages received from the system controller to paging units and for sending periodically a system message having at least information which identifies the transmission system to distinguish the transmission system from other transmission systems in the paging system;

a plurality of paging units for receiving the system messages of at least one of the transmission systems when located in the associated coverage area of said one transmission system and receiving the page messages from the transmission system registered to the paging unit when the paging unit is located in the coverage area of the transmission system registered to the paging unit, in which one or more of said plurality of paging units are one-way paging units;

each of said paging units including a memory storing information representing the current registered transmission system of the paging unit and a respective paging unit controller for determining when the paging unit receives at least one of the system messages sent by one of said transmission systems different from the current transmission system registered to the paging unit;

sending means for sending to the system controller at least information identifying the transmission system from said received system message sent by one of said transmission systems different from the current transmission system registered to the paging unit; and said system controller having updating means, responsive to said sending means, for updating the registration of the paging unit in the routing database to one of the transmission systems different from the current transmission system and sending to the paging unit via one of said transmission systems at least information representing the updated transmission system registered to the paging unit.

2. The paging system according to claim 1 wherein said paging unit controller is operative to update said memory of the paging unit in accordance with the information representing the updated transmission system received from the system controller via one of said transmission systems.

3. The paging system according to claim 1 wherein said updating means of the system controller updates the registration to another of the transmission systems having approximately the same coverage area as the transmission system identified by the information from said sending means.

4. The paging system according to claim 1 wherein each of the paging units further comprises means for notifying the user of the paging unit of the need to update the registration of the paging unit.

5. The paging system according to claim 1 wherein:

each of said transmission systems further comprises a time source for provide time information, and sends in said system message the time of transmission of the system message in accordance with said time information; and said paging units each have a clock which is maintained in correspondence with the time of transmission of one or more of the system messages received by the paging unit.

6. The paging system according to claim 1 wherein said sending means comprises an audio interface integrated on the paging unit capable of transmitting audio signals for establishing a telephonic connection to the system controller and transmitting data to the system controller.

7. The paging system according to claim 1 wherein a respective said sending means is associated with a respective each of said paging units and further comprises transmitting means for automatically establishing telephonic connection to the system controller for transmitting data.

8. The paging system according to claim 1 further comprising one or more system control input units which receives data from the sending means and transmits said received data to said system controller representing at least information which uniquely identifies the transmission system having sent the last system message received by the paging unit and uniquely identifies the paging unit.

9. The paging system according to claim 1 wherein said sending means sends data to said system controller by one of a telephonic-based connection and a two-way paging network.

10. The paging system according to claim 1 further comprising at least one message input unit for inputting page messages to the system controller having information designated to one or more of said paging units for routing respectively to the respective transmission systems to which the paging units are registered.

11. The paging system according to claim 1 wherein each of said one-way paging units is associated with a respective sending means that is external to the one-way paging unit and each one-way paging unit further comprises:

a paging receiver for receiving page messages and system messages when located in the coverage area of at least one of the transmission systems;

a decoder for decoding received system messages, and received page messages when addressed to the paging unit; and the paging unit controller being operative for automatically enabling said sending means.

12. The paging system according to claim 1 wherein each of said transmission systems comprises:

a time source for providing date and time;

a system message generator for generating periodically the system messages having said information, said information uniquely identifying said transmission system, and said date and time from said time source;

a paging encoder for encoding generated system messages in accordance with a paging protocol;

a regional controller for formatting the encoded system messages; and one or more transmitter sites having antennas which broadcast said formatted encoded system messages in the coverage area of the transmission system.

13. The paging system according to claim 1 wherein each of said transmission systems includes a paging encoder for encoding page messages received from the system controller, a regional controller for formatting the encoded page messages, and one or more transmitter sites for broadcasting said formatted encoded page messages.

14. The paging system according to claim 1 wherein said system controller further comprises:

a time source for providing date and time; and a message database stored in said memory of the system controller having copies of each page message routed to each of the paging units with the time from said time source that the page message was routed.

15. The paging system according to claim 1 wherein one or more of said plurality of paging units comprise two-way paging units.

16. The paging system according to claim 1 wherein the information sent in the system message from each of the transmission systems identifying the transmission system represents a unique identifier for the transmission system, and said page controller of each of said paging units further comprises:

means for comparing the information stored in said memory with the identifier of each received system message to determine when the paging unit receives one of the system messages sent from one of said transmission systems different from the transmission system to which the paging unit is registered.

17. The paging system according to claim 1 wherein each of said transmission systems comprises one or more transmission sites in the coverage area associated with the transmission system for enabling page messages to reach the paging units in the coverage area associated with the transmission system.

18. The paging system according to claim 1 wherein the system message is embedded in the radio paging protocol used by one or more of said transmission systems.

19. The paging system according to claim 1 wherein each of said transmission systems has a respective unique identifier and the system message of each of the transmission systems includes at least the respective unique identifier for the transmissions system, wherein said unique identifier represents the information uniquely identifying the transmission system.

20. The paging system according to claim 19 wherein said unique identifier of each of said transmission systems represents a unique first identifier comprising at least a second identifier in coded form representing a regional transmission system operating in said wide area and a third identifier in coded form representing the frequency of transmission of the transmission system.

21. The paging system according to claim 20 wherein each of the paging units has a receiver which, responsive to receiving the first identifier of the updated transmission system registered to the paging unit from the system controller, is set to receive paging messages and system messages for the frequency of transmission in accordance with the third identifier of the first identifier of the updated transmission system.

22. The paging system according to claim 20 wherein the sending means sends at least information including said second identifier of the transmission system of the received system message, and the updating means of the system controller, responsive to the sending means, updates the registration of the paging unit to the first identifier of the transmission system having at least the second identifier which is the same as the second identifier received from the sending means.

23. The paging system according to claim 20 wherein the sending means sends at least said information including said second identifier of the received system message, and the updating means of the system controller, responsive to the sending means, updates the registration of the paging unit to the first identifier of the transmission system having the second identifier which is the same as the second identifier received from the sending means and the third identifier representing the frequency of the transmission system having available page messaging capacity in the coverage area associated with the second identifier received from the sending means.

24. The paging system according to claim 19 wherein said unique identifier of each of said transmission systems represents a unique first identifier, each of said paging units has a unique paging unit identifier, and said sending means comprises:

means for sending to the system controller at least the unit identifier of the paging unit and the first identifier of the transmission system from the received system message sent from one of the transmission systems different than the transmission system to which the paging unit is registered.

25. The paging system according to claim 24 wherein said routing database associates the unit identifier of each of said paging units to the first identifier of the transmission system to which the paging unit is registered.

26. The paging system according to claim 25 wherein said updating means of the system controller revises the routing database to register the paging unit of the received unit identifier to a transmission system having one of:

(a) the first identifier of the transmission system in the information received from the sending means, and (b) the first identifier of the transmission system having approximately the same coverage area as that associated with the first identifier of the transmission system in the information received from the sending means.

27. The paging system according to claim 1 wherein some of the transmission systems have approximately the same coverage area, and said transmission systems having approximately the same coverage area operate on different transmission frequencies, and wherein at least one transmission system in each of plural coverage areas in said wide area operates for transmission of system messages on a common frequency that is common to operation of said at least one transmission system in other of the plural coverage areas, and each of said paging units are capable of receiving the system messages when transmitted on the common frequency when the paging unit is within the coverage area of a transmission system that transmits system messages on the common frequency.

28. The paging system according to claim 27 wherein each of said paging units, responsive to receiving an updated transmission system registration, receives the system messages and the page messages on the transmission frequency of the updated transmission system.

29. The paging system according to claim 1 wherein said updating means of the system controller sends the information representing the updated transmission system to the paging unit in a confirmation message.

30. The paging system according to claim 29 wherein said updating means of the system controller sends the confirmation message by routing the confirmation message through the transmission system identified by the sending means.

31. The paging system according to claim 1 wherein each of said paging units further comprises means for recording one or more time periods in said memory of the paging unit related to possible nonreceipt of page messages when the paging unit is operative to receive within a predefined interval but has not received within the predefined interval, the system message or messages of the transmission system to which the paging unit is currently registered.

32. The paging system according to claim 31 wherein said sending means further comprises means for sending to the system controller data representing said one or more time periods in said memory of the paging unit.

33. The paging system according to claim 31 wherein said sending means is operative to send to the system controller data representing said time periods in said memory of the paging unit when one of a certain input from the user of the paging unit is received by the paging unit and said one or more of said time periods exceed a predefined interval.

34. The paging system according to claim 31 wherein said recording means of each of said paging units further records in said memory one or more time periods when the paging unit is logically off.

35. The paging system according to claim 32 wherein said system controller further comprises:

a time source for providing time information;

a message database stored in said memory of the system controller having copies of each of the page messages routed to each of the paging units with at least the time information from said time source when the page message was routed; and means for receiving the data representing said one or more time periods and resending any page messages sent during said one or more time periods to the paging unit which sent the data representing the one or more time periods.

36. The paging system according to claim 1 wherein:

one or more of said paging units are two-way paging units;

one or more of said transmission systems have a two-way paging receiver network capable of communication with the two-way paging unit when located in their coverage areas; and a respective one of said sending means is associated with a respective one of each of the two-way paging units and comprises means for sending, via the two-way paging receiver network of one of the transmission systems, to the system controller at least the information identifying the transmission system from the system message received from one of the transmission systems different from the registered transmission system of the paging unit.

37. The paging system according to claim 36 wherein:

each of said transmission systems further sends information in said system message indicating whether the transmission system has a two-way paging receiver network; and said sending means associated with a paging unit that is a two-way paging unit that communicates to the system controller via a two-way receiving network of a transmission system having a two-way paging receiver network, when the received system message sent from one of the transmission systems other than the transmission system to which the paging unit is registered has the information indicating a two-way paging receiver network is available.

38. The paging system according to claim 36 wherein said sending means of the paging units representing two-way paging units is capable of communicating through a telephonic-based connection to the system controller when the paging unit is located in the coverage area of any one of the transmission systems.

39. The paging system according to claim 1 wherein the sending means further comprises a telephone and wherein each of said transmission systems further sends in said system message information representing a telephone number for use in communicating with the system controller.

40. The paging system according to claim 39 wherein said sending means further comprises a connection to the system controller for sending data identifying the transmission system which sent the received system message received by the paging unit.

41. The paging system according to claim 1 wherein a respective said sending means is associated with a respective each of said one-way paging units, and each of said respective sending means further comprises:

an external interface, external to the one-way paging unit, for sending signals; and a device for receiving said signals and establishing a connection with the system controller for transmitting data.

42. The paging system according to claim 41 wherein said device represents one of a cell and land telephone capable of receiving said signals from said external interface.

43. The paging system according to claim 1 wherein a respective said sending means is associated with a respective each of said one-way paging units and further comprises transmitting means for transmitting data to the system controller via a telephonic connection enabled by the user of the paging unit.

44. The paging system according to claim 43 wherein said transmitting means for transmitting data to the system controller further comprises one or more push buttons on the paging unit to establish said telephonic connection and send data to the system controller.

45. The paging system according to claim 1 wherein said memory of the system controller stores a group database identifying groups of one or more of said paging units under unique group identifiers, and said system controller further comprises means for receiving a page message referencing one of the group identifiers and determining which transmission systems have registered paging units that are identified with the group identifier and routing said page message to said transmission systems having registered paging units that are identified with the group for transmission to each of the paging units of the group in accordance with said group database and through the respective registered transmission system of the paging unit.

46. The paging system according to claim 45 wherein each of said paging units has a unique unit identifier and at least some of the paging units have an associated group identifier that is stored in the memory of the paging unit and each of said at least some of the paging units having an associated group identifier further comprises means for receiving a page message addressed to one of the unit identifier for the paging unit and one of the group identifier to which the paging unit is associated.

47. The paging system according to claim 1 wherein the information in each of the system messages which identifies the transmission system sending the system message comprises a regional identifier in coded form and a frequency identifier in coded form representing the frequency at which the transmission system operates for transmitting page messages.

48. The paging system according to claim 47 wherein the information in each of the system messages which identifies the transmission system sending the system message further a system identifier distinguishing said system from any other systems for providing page message to paging units.

49. The paging system according to claim 1 wherein each of said paging units is controlled so that when operative to receive but not receiving said system message from the transmission system to which said paging unit is registered within a predefined interval the paging unit enters a no service state until one of the system messages from the transmission system to which said paging unit is registered is again received, and said paging unit receives from said system controller information identifying the updated transmission system registered to the paging unit.

50. The paging system according to claim 49 wherein said paging units each further comprises:

a time source for providing time information; and means for recording one or more time periods in an array in said memory in accordance with said time source when the paging unit is in the no service state.

51. The paging system according to claim 49 wherein:

one of the transmission systems has approximately the same coverage area as another transmission system of the transmission systems and some of the transmission systems have different coverage areas from each other and the transmission systems having approximately the same coverage area operate on different frequencies to send page messages and system messages;

said transmission systems having different coverage areas operate on a common frequency;

each of the paging units are capable of receiving page messages and system messages on the different frequencies and the common frequency; and each of the paging units after entering the no service state resets the frequency of reception to the common frequency.

52. A paging system for providing page messages to radio paging receiving units over a wide area through a plurality of regional transmission systems, said system comprising:

means for routing page messages to each of said paging units through one of said transmission systems to which the paging unit is registered, each of said paging units being registered to one of said transmission systems;

means for maintaining in a database copies of each of the page messages routed to one or more of said paging units with a time associated with a page message;

a plurality of regional transmission systems having coverage areas in said wide area in which each of said transmission systems sends page messages received from the routing means to paging units located in their associated coverage area and sends a periodic system message having information which uniquely identifies the transmission system to paging units located in their associated coverage area;

a plurality of paging units capable of receiving page messages and system messages when located in the coverage area of at least one of the transmission systems, in which each of said paging units, when receiving at least one of the system messages sent from one of said transmission systems different from the transmission system to which said paging unit is registered, transmits to the routing means at least the information from the received system message identifying the transmission system, a memory and a paging unit controller in at least one of the paging units for determining a time period or periods in which system messages were not received after a predefined interval from the transmission system to which the paging unit is registered;

said routing means in response to each of said paging units comprises means for re-registering the paging unit to one of the transmission systems whose coverage area the paging unit has entered in accordance with the information transmitted from the paging unit; and means for resending from the database copies of any page messages sent to a paging unit which were routed during any of said time period or periods and which may not have been received by the paging unit during said time period or periods.

53. The paging system according to claim 52 wherein said re-registration means further comprises means for sending to the paging unit information having at least the transmission system to which the paging unit is re-registered.

54. The paging system according to claim 52 further comprising:

wherein said at least one of the paging units having the memory in the paging unit controller comprise one-way paging units.

55. A method for providing page messages to radio receiving paging units over a wide area through a plurality of regional transmission systems comprising the steps of:

registering each of said paging units to one of said transmission systems, in which one or more of said paging units comprise one-way paging units, a memory of each paging unit storing information representing the one of said transmission systems to which the paging unit is registered;

routing page messages to each of said paging units through one of said transmission systems to which the paging unit is registered;

sending routed page messages by each of the transmission systems to the paging units located in coverage areas associated with said transmission systems;

sending a periodic system message from each of said transmission systems having information which identifies the transmission system to one or more of said paging units located in the coverage area of the transmission system;

receiving at each of the paging units page messages sent from the transmission system registered to the paging unit when located in the coverage area of the transmission system registered to the paging unit;

receiving at least one system message at each of the paging units when the paging unit is located in the coverage area of at least one of the transmission systems;

re-registering one of the paging units to a different one of said transmission systems from the transmission system the paging unit is registered when the paging unit receives at least one of the system messages sent from one of said transmission systems different from the transmission system to which said paging unit is registered and wherein at least one of the system messages includes an identifier that identifies a transmission system different from the transmission system the paging unit is registered to in accordance with a comparison with the information stored in the memory of the paging unit; and sending to said paging unit, subsequent to said at least one of the system messages, a message having information representing the transmission system to which the paging unit is re-registered and storing this information in the memory to provide an updated registration of the paging unit.

56. The method according to claim 55 further comprising:

recording one or more time periods in which the paging unit does not receive within a predefined interval the system message of the transmission system to which the paging unit is registered;

storing in a message database copies of each page message routed to each of the paging units with time information associated with the page message; and resending any page messages routed to the paging unit during said one or more time periods in accordance with said message database.

57. The method according to claim 55 wherein the system message sent by each of the transmission systems is embedded in the radio paging protocol used by at least one of said transmission systems.

58. A method for routing page messages to radio receiving paging units through one or more transmission systems comprising the steps of:

receiving page messages, each of said page messages having message data and identifying information of one or more of the paging units to receive the page message;

storing in at least one first database information associating each paging unit to one of the transmission systems;

routing each page message received to one of the transmission systems in accordance with said identifying information of the page message and the information of said first database for sending of the page message to a respective paging unit by a respective one of the transmission systems;

storing in at least one second database information about each page message routed representing at least the paging unit associated with the page message in accordance with the identifying information of the page message, the message data of the page message, and the time the page message was routed;

maintaining in at least one of the paging units one or more records of certain time periods related to possible nonreceipt of messages transmitted to said at least one of the paging units; and resending page messages to said at least one of the paging units from said second database any message previously sent to said at least one of the paging units having a time routed during said certain time periods.

59. The method according to claim 58 further comprising the step of updating said first database to register one of the paging units with another of the transmission systems after the one paging unit moves into the coverage area of one of the transmission systems different from the transmission system to which the paging unit is registered and storing information identifying the another of the transmission systems in a memory of the said one of the paging units.

60. A one-way radio receiving paging unit for receiving messages from one or more transmission systems having coverage areas in which each radio paging unit is registered to one of the transmission systems for receiving paging messages from the transmission system, and each transmission system sends a periodic system message identifying the transmission system and a telephone access number for use in changing registration of a paging unit, the one-way radio paging unit comprising:

a receiver for receiving the system messages of at least one of the transmission systems when the one-way paging unit is located in the coverage area of said one of said transmission systems, and receiving the page messages sent from the transmission system registered to the one-way paging unit when the one-way paging unit is located in the coverage area of the transmission system registered to the one-way paging unit;

means, including a memory storing information related to the transmission system registered to the paging unit, for determining when the one-way paging unit receives at least one of the system messages sent by one of said transmission systems different from the transmission system registered to the one-way paging unit; and means, responsive to said determining means, for providing a signal including information corresponding to the telephone access number for use in changing registration of the one-way paging unit.

61. The paging unit according to claim 60 and including a display, responsive to the signal, for displaying the telephone access number for changing registration.

62. The paging unit according to claim 60 in combination with a communication device for automatically dialing the telephone access number in response to the signal.

63. A method of providing page messages to radio receiving paging units over a wide area through a plurality of regional page message transmission systems comprising the steps of:

registering each of said paging units to a respective one of said regional transmission systems in accordance with an identification code for the respective regional transmission system stored in a memory of the respective paging unit to provide each of the respective paging units with an identification code of a current registration of the regional transmission system to which it is currently registered;

transmitting system messages from each of the regional transmission systems which include information identifying respectively the respective regional transmission system;

determining for each paging unit if it has received, within a predetermined period of time, system messages from the respective regional transmission system to which it is currently registered identifying the regional transmission system;

storing in memory within a paging unit information relative to a period or periods of nonreceipt of the system messages from the respective currently registered regional transmission system;

communicating to a controller external to the paging unit information relative to a period or periods of nonreceipt of the system messages from the respective currently registered regional transmission system; and newly transmitting in accordance with the information relative to the period or periods of nonreceipt, page messages to the paging unit comprising page messages previously transmitted by the previously currently registered regional transmission system to the paging unit during the period of nonreceipt.

64. The method according to claim 63 further comprising the step of modifying the registration of the paging unit to a different identification code and establishing an updated registration for routing of page messages from a different regional transmission system and wherein the step of newly transmitting the page messages is performed by the different regional transmission system.

65. A paging unit for use in a wide area transmission system having a plurality of regional transmission systems each providing periodic system messages, the wide area transmission system having a system controller and a storage system for storing page messages previously routed for transmission to paging units with associated time information, the paging unit comprising:

a paging unit controller within the paging unit operative to determine if there is receipt by the paging unit of periodic system messages transmitted by one of the regional transmission systems, and in response to a determination by the paging unit controller that there is nonreceipt of the periodic system messages for a predetermined time period or periods during which the paging unit is operative to receive the periodic system messages, the paging unit controller is operative to provide a signal to identify the period or periods of nonreceipt of system messages.

66. The paging unit according to claim 65 further comprising a display operative in response to the signal for displaying the period or periods of nonreceipt of system messages.

67. A controller for routing messages to radio receiving paging units in a wide area paging system having plural transmission systems with coverage areas in the wide area, in which the radio paging units can detect when they have moved into a new coverage area of one of the transmission systems, said controller comprising:

memory storing a routing database registering each of said paging units with one of said transmission systems;

means for routing page messages to each of said paging units through one of said transmission systems to which the paging unit is registered in accordance with said routing database, in which one or more of said plurality of paging units represent one-way paging units; and means for updating the registration of the paging unit in the routing database to one of the transmission systems and sending for transmission to the paging unit information representing the updated transmission system registered to the paging unit and sending to said updated transmission system for transmission to said paging unit page messages previously transmitted to the paging unit by the paging unit's previously registered transmission system.

68. A method of providing page messages to a radio receiving paging unit over a wide area through a plurality of regional page message transmission systems forming part of a page message delivery communication system, the method comprising the steps of:

providing a registration of the paging unit to a respective first of said regional transmission systems in accordance with a regional identifier code for the first regional transmission system, said code being stored in a memory of the paging unit;

periodically transmitting system messages from each of the regional transmission systems which includes information identifying respectively the respective regional transmission system;

determining if the paging unit is receiving a system message from a regional transmission system that the paging unit is not registered to;

providing a request to change the registration of the paging unit and identifying a second regional transmission system from which it is has received a system message and which is different from said first regional transmission system which the paging unit is currently registered to;

providing an updated registration for the paging unit and providing an updated registration code stored in the memory of the paging unit, the updated registration code including a regional identifier code identifying a third regional transmission system that is different than the regional identifier code identifying said first registered transmission system and different than a regional identifier code associated with said second regional transmission system;

routing page messages intended for transmission to the paging unit from the third regional transmission system in order to balance the page message delivery load of the page delivery communication system.

69. A method of providing page messages to radio receiving paging units over a wide area through a plurality of regional page message transmission systems forming part of a page message delivery communication system, the method comprising the steps of:

registering each of said paging units to a respective one of said regional transmission systems in accordance with an identification code for the respective regional transmission system stored in a memory of the respective paging unit to provide each of the respective paging units with an identification code of a current registration of the regional transmission system to which it is currently registered, wherein the registration code of a paging unit includes information relative to identification of a first regional transmission system and a first frequency of transmission of messages;

periodically transmitting system messages from each of the regional transmission systems which includes information identifying the respective regional transmission system and a frequency of transmission of messages;

determining for a paging unit that it is receiving a system message from a second regional transmission system that it is not registered to, said system message being received by the paging unit at the first frequency;

providing a request to change registration of the paging unit in accordance with a determination from said determining step;

modifying the registration code of the paging unit to establish an updated registration for receipt of page messages with an updated registration code, the updated registration code including information relative to identification of the second regional transmission system and the second frequency of transmission of messages; and routing page messages intended for transmission to the paging unit from the second regional transmission system at the second frequency in order to balance the page message delivery load of the second regional transmission system.

70. A method of providing page messages to a radio receiving paging unit comprising the steps of:

transmitting system messages and page messages from a transmission system, the system messages including information identifying the transmission system;

storing in memory within the paging unit information relative to a period of nonreceipt of system messages from the transmission system;

communicating to a controller external to the paging unit information relative to a period of nonreceipt of the system messages from the transmission system; and newly transmitting to the paging unit from a transmission system, in accordance with the information relative to the period of nonreceipt, page messages previously transmitted to the paging unit during the period of nonreceipt but not received by the paging unit during said period.

71. A method of operation of a paging unit for use in a wide area transmission system having a plurality of regional transmission systems each providing periodic system messages, the wide area transmission system having a system controller and a storage system for storing page messages previously routed for transmission to paging units with associated time information, the method comprising:

operating a paging unit controller within the paging unit to determine if there is receipt by the paging unit of periodic system messages transmitted by one of the regional transmission systems; and in response to a determination by the paging unit controller that there is nonreceipt of the periodic system messages for a predetermined time period or periods, providing a signal by the paging unit to identify the period or periods of nonreceipt of system messages.

* * * * *